US007420115B2

(12) United States Patent
Kawamoto et al.

(10) Patent No.: US 7,420,115 B2
(45) Date of Patent: Sep. 2, 2008

(54) MEMORY ACCESS CONTROLLER FOR MUSICAL SOUND GENERATING SYSTEM

(75) Inventors: Ryuichi Kawamoto, Hamamatsu (JP); Masahiro Shimizu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 240 days.

(21) Appl. No.: 11/318,313

(22) Filed: Dec. 23, 2005

(65) Prior Publication Data

US 2006/0137515 A1 Jun. 29, 2006

(30) Foreign Application Priority Data

Dec. 28, 2004 (JP) ..... 2004-378785
Dec. 28, 2004 (JP) ..... 2004-378794

(51) Int. Cl.
*G10H 1/00* (2006.01)
*G10H 1/18* (2006.01)
*G10H 7/00* (2006.01)

(52) U.S. Cl. ..... 84/615; 84/604; 84/609; 84/610; 84/618

(58) Field of Classification Search ..... None
See application file for complete search history.

(56) References Cited

U.S. PATENT DOCUMENTS 4,709,611 A * 12/1987 Takagi et al. ..... 84/627
5,321,198 A 6/1994 Suzuki et al.
5,463,183 A 10/1995 Konno
5,525,748 A 6/1996 Kuribayashi et al.
5,539,145 A 7/1996 Kuribayashi et al.
5,668,334 A * 9/1997 Kuribayashi et al. ..... 84/602
5,714,704 A * 2/1998 Suzuki et al. ..... 84/604
5,770,812 A * 6/1998 Kitayama ..... 84/603
6,441,290 B2 * 8/2002 Fujita et al. ..... 84/603
2001/0054348 A1 * 12/2001 Ikeya ..... 84/604

(Continued)

FOREIGN PATENT DOCUMENTS

JP 5066777 3/1993

(Continued)

*Primary Examiner*—Marlon T Fletcher
(74) *Attorney, Agent, or Firm*—Morrison & Foerster LLP

(57) ABSTRACT

In an access controller provided for a musical sound signal generating system, a signal generating section operates when a readout of wave data of one block stored in a working memory is completed in a sound channel, for supplying a next waveform request signal to a CPU, which requests a next block of the wave data for the sound channel. First and second buffer memories are connected between a recording medium and the working memory respectively through first and second buses which are independent from each other. A first transmitting section operates when receiving block specifying information from the CPU, which specifies a block to be read next from the recording medium, for transmitting the wave data of the specified block to either of the first or second buffer memory while reading the specified block of the wave data from the recording medium. A second transmitting section operates when the transmitting of the wave data to either of the first or second buffer memory is finished and during a period when the musical sound signal generation system is not accessing the working memory, for transmitting the wave data of the specified block to the working memory from either of the first or second buffer memory, to which the wave data of the specified block has been transmitted by the first transmitting section.

8 Claims, 14 Drawing Sheets

U.S. PATENT DOCUMENTS

| | | | | |
|---|---|---|---|---|
| 2002/0134217 | A1* | 9/2002 | Tamura | 84/603 |
| 2005/0211070 | A1* | 9/2005 | Tamura | 84/603 |

FOREIGN PATENT DOCUMENTS

| | | |
|---|---|---|
| JP | 6051776 | 2/1994 |
| JP | 2002/073537 | 3/2002 |
| JP | 2002/366373 | 12/2002 |
| JP | 2003/022248 | 1/2003 |
| JP | 2004/070579 | 3/2004 |

* cited by examiner

DISPLAY
2
INPUT DEVICE
4
CPU
6
DMA CONTROLLER
8
FLASH MEMORY
10
RAM
12
COMMUNICATION I/F
14
16
HARD DISK
36
CD-RW DRIVE
38
IDE I/O
34
40
TRANSMISSION
32
RAM
30
RAM
28
29
27
TRANSMISSION
26
TRANSMISSION CONTROL
WAVEFORM MEMORY
22
24
TONE GENERATOR
20
SOUND CARD
SOUND SYSTEM
18

MEMORY ACCESS CONTROLLER FOR MUSICAL SOUND GENERATING SYSTEM

BACKGROUND OF THE INVENTION

1. Technical Field

The present invention relates to a memory access controller suitable for use in generating a musical sound signal by a personal computer.

2. Background Art

In recent years, there has been known a system for composing a memory tone generator using a personal computer to thereby generate a musical sound signal based on musical performance information. In such a system, wave data stored in a hard disk are read into a buffer memory in units of partial data (data block, for example one cluster), and contents of this buffer memory are further transmitted to a waveform memory. An envelope is then given to the wave data in this waveform memory, and a sound effect process is performed thereto, whereby the musical sound signal is generated (Patent Documents 1 to 3). In the hard disk, however, due to a large time lag until the data are actually read after receiving a read instruction from a CPU, the CPU needs to output the read instruction in advance to the hard disk before a time when the partial data (data block) is actually required.

[Patent Document 1]

Japanese Patent Publication No. 2671747

[Patent Document 2]

Japanese Patent Publication No. 2768204

[Patent Document 3]

Japanese Patent Publication No. 2798077

For instance, Patent Document 2 discloses a technique providing a pair of memory regions of a "first half" and a "last half" in the waveform memory for every sound channel to continuously play back the wave data by alternately accessing the pair of the regions. In this technique, successive address spaces are given to the regions of the "first half" and the "last half", and the regions of the "first half" and the "last half" are alternately read by a tone generator circuit. As a result, a read address is changed in the shape of a sawtooth wave. When a readout of the region of the "first half" is completed by the tone generator circuit, an interruption is generated to the CPU and, under the control of the CPU, new partial data are read from the hard disk to the region of the "first half". In parallel with this, the region of the "last half" is read by the tone generator circuit, and the musical sound signal is then synthesized based on the partial data in the region of the "last half".

Similarly, when the readout of the region of the "last half" is completed by the tone generator circuit, an interruption is generated to the CPU and, under the control of the CPU, new partial data are read from the hard disk to the region of the "last half". In parallel with this, the region of the "first half" is read by the tone generator circuit, and the musical sound signal is then synthesized. In this way, a partial data transmission to one region and a playback of data using the other region are repeatedly performed. Here, a speed of reading respective regions is determined based on a pitch (f-number) of the corresponding sound channel. Accordingly, one kind of wave data can be applied now to various pitches.

A progress situation of read addresses of a plurality of channels will now be explained using FIG. 2(*b*). Since a speed of reading the waveform memory for each sound channel is determined based on a pitch (f-number) of the sound channel, periods of the sawtooth waves tracing the read addresses are different for each sound channel as shown in the chart. In any sound channels, interruptions occur for every half period of the sawtooth wave, namely at timings indicated by white round marks, and an update of a channel corresponding memory region of a "first half" or a "last half" is started. When the periods of the sawtooth waves are different for every channel like this, many interruptions of the sound channels may occur almost at the same time near a certain timing (time tp in an example of the chart).

Incidentally, when the interruptions intensively occur like this, partial data will come to be read from a hard disk almost continuously. In order to write the wave data read from the hard disk in a buffer memory, however, it is necessary to transmit in advance the wave data previously stored in the buffer memory, to the waveform memory. As a result, even when the hard disk itself is in a readable state, there is a need to suspend the data read from the hard disk depending on a state of the buffer memory, whereby there has been a problem that the supply of the partial data does not meet the requirement.

When the periods of the sawtooth waves are different for every channel as shown in FIG. 2(*b*), many interruptions of the sound channels may occur almost at the same time near a certain timing (time tp in an example of the chart). If the interruptions intensively occur like this, the timing for reading the partial data from the hard disk gets delayed, whereby there has been a problem that the supply of the partial data does not meet the requirement especially to a channel with a short period of the read address.

SUMMARY OF THE INVENTION

The present invention has been made in view of the foregoing situation, and aims to provide an access controller which can promptly transmit respective wave data to the waveform memory. The present invention also aims to provide an access controller and a musical sound signal generating method, which allow the transmission of each partial data on an optimal schedule according to a timing when the partial data of each sound channel are required.

The present invention for solving the aforementioned problems is characterized by having following configurations. It should be noted that a term inside parentheses is an exemplification.

In a first aspect of the invention, there is provided an access controller apparatus applied to a musical sound signal generating system having a first disk-like recording medium (36) for storing wave data in units of a block (cluster) having a predetermined size, a control section (6) for determining a block to be read next from the first recording medium (36), a second recording medium (22) for storing wave data and having an access speed faster than that of the first recording medium (36), and a musical sound signal generation section (20) for reading wave data from the second recording medium (22) at a speed corresponding to a reproduction rate of each sound channel to thereby generate a musical sound signal through each sound channel, the access controller comprising: a next waveform request signal generating section (20) that operates when a readout of the wave data of one block stored in the second recording medium (22) is completed in a sound channel, for supplying a next waveform request signal (interruption signal of block reproduction completion) which requests a next block of the wave data for said sound channel, to the control section (6); first and second buffer memories (28, 30) respectively connected to first and second buses (27, 29) which are independent from each other; a first transmitting section (32) that operates when receiving block specifying information (sound channel i and next waveform block number NW(i)) which specifies a block to be read next from the first recording medium (36), from the control section (6), for transmitting the wave data of the specified block to one of the first and second buffer memories (28, 30) while reading the specified block of the wave data from the first recording medium (36); and a second transmitting section (26) that operates when the transmitting of the wave data to said one of the first and second buffer memories (28, 30) by the first transmitting section (32) is completed, and during a period when the musical sound signal generation section (20) is not accessing the second recording medium (22), for transmitting the wave data of the specified block to the second recording medium (22) from said one of the first and second buffer memories (28, 30), to which the wave data of the specified block have been transmitted by the first transmitting section (32).

Moreover, in the inventive access controller apparatus, on condition that transmitting of the wave data of a previous block by the first transmitting section (32) has been completed, the control section (6) supplies the block specifying information (sound channel i and next waveform block number NW(i)) according to the next waveform request signal (interruption signal of block reproduction completion) to the first transmitting section (32), and enables the second transmitting section (26) to set a destination region of the wave data of the next block specified by the block specifying information in the second recording medium (22).

In a second aspect of the invention, there is provided an access controller apparatus applied to a musical sound signal generating system including a first recording medium (36) for storing wave data, a second recording medium (22) having an access speed faster than that of the first recording medium (36), a transmitting section (26, 32) for reading wave data sequentially in units of a data block composing a part of the wave data to thereby transmit the wave data to the second recording medium (22), and a musical sound signal generating section (20) having a plurality of sound channels each of which reads the wave data from the second recording medium (22) at a speed corresponding to a reproduction rate of each sound channel to reproduce a musical sound signal according to the read wave data, the access controller apparatus comprising: a detecting section (24, SP60 through SP70, and SP46) for detecting a sound channel which will complete the reproducing of the data block stored in the second recording medium (22) at the earliest timing among the sound channels capable of reading a next data block which should be transmitted to the second recording medium (22), and a sound channel specifying section (24, SP48) for specifying the sound channel detected by the detecting section as a sound channel for which the transmitting section (26, 32) should transmit the next data block.

Moreover, in the inventive access controller apparatus, the musical sound signal generating system has a rate storage section (12) for storing the reproduction rate of each sound channel, the first recording medium (36) is a recording medium for storing the wave data in units of a data block having a predetermined size (cluster), and the second recording medium (22) has a pair of storage regions (BiF, BiR) for each sound channel and each of the data locks is alternately written to the pair of the storage regions.

Moreover, in the inventive access controller apparatus, the detecting section produces a list of the sound channels in an ascending order of the timings at which the respective sound channels complete reproducing of the block data stored in the second recording medium (22) for detecting the sound channel ranked at the top order in the list.

Moreover, according to the second aspect of the invention, there is provided a musical sound signal generating method performed in a musical sound signal generating system, wherein the musical sound signal generating system includes a first recording medium (36) for storing wave data, a second recording medium (22) having an access speed faster than that of the first recording medium (36), a transmitting section (26, 32) for reading the wave data sequentially in units of a data block composing a part of the wave data from the first recording medium (36) to thereby transmit the wave data to the second recording medium (22), and a musical sound signal generation section (20) having a plurality of sound channels each of which reads the wave data from the second recording medium (22) at a speed corresponding to a reproduction rate of each sound channel to reproduce a musical sound signal according to the read wave data, the musical sound signal generating method causing a processor (6) to execute: a detecting step (SP60 through SP70, and SP46) of detecting a sound channel which will complete the reproducing of the data block stored in the second recording medium (22) at the earliest timing among the sound channels capable of reading a next data block which should be transmitted to the second recording medium (22), and a sound channel specifying step (SP48) of specifying the sound channel detected in the detecting step as a sound channel for which the next data block should be transmitted to the second recording medium by the transmitting section (26, 32).

Moreover, in the inventive musical sound signal generating method, the musical sound signal generating system has a rate storage section (12) for storing the reproduction rate of each sound channel, the first recording medium (36) is a recording medium for storing the wave data in units of the data block having a predetermined size (cluster), the second recording medium (22) has a pair of storage regions (BiF, BiR) for each sound channel such that each data block is alternately written to either of the pair of the storage regions, and the detecting step includes producing a list (SP68) of the sound channels in an ascending order of the timings at which the respective sound channels complete the reproducing of the data blocks stored in the second recording medium (22) for detecting the sound channel ranked at a top order in the list.

As described above, according to the first aspect of the present invention, when receiving the block specifying information, the first transmitting section transmits the wave data of the block to either of the first and second buffer memories while reading the wave data of the block from the first recording medium, and the second transmitting section transmits the wave data to the second recording medium from the buffer memory to which the wave data has been transmitted, during the period when the musical sound signal generation section is not accessing the second recording medium, thereby making it possible to promptly transmit the wave data to the second recording medium.

As described above, according to the second aspect of the present invention, among the sound channels available for reading the next partial data to the second recording medium, the sound channel whose playback by the partial data stored in the second recording medium will be completed at the earliest timing is detected, and the detected sound channel is specified as the sound channel given the top priority to which the partial data should be transmitted immediately by the transmitting section, thereby making it possible to transmit respective partial data on the optimal schedule according to the timing when the partial data of respective sound channels are required.

DETAILED DESCRIPTION OF THE INVENTION

1. First Embodiment

1.1. Hardware Configuration of First Embodiment

Figure 1:
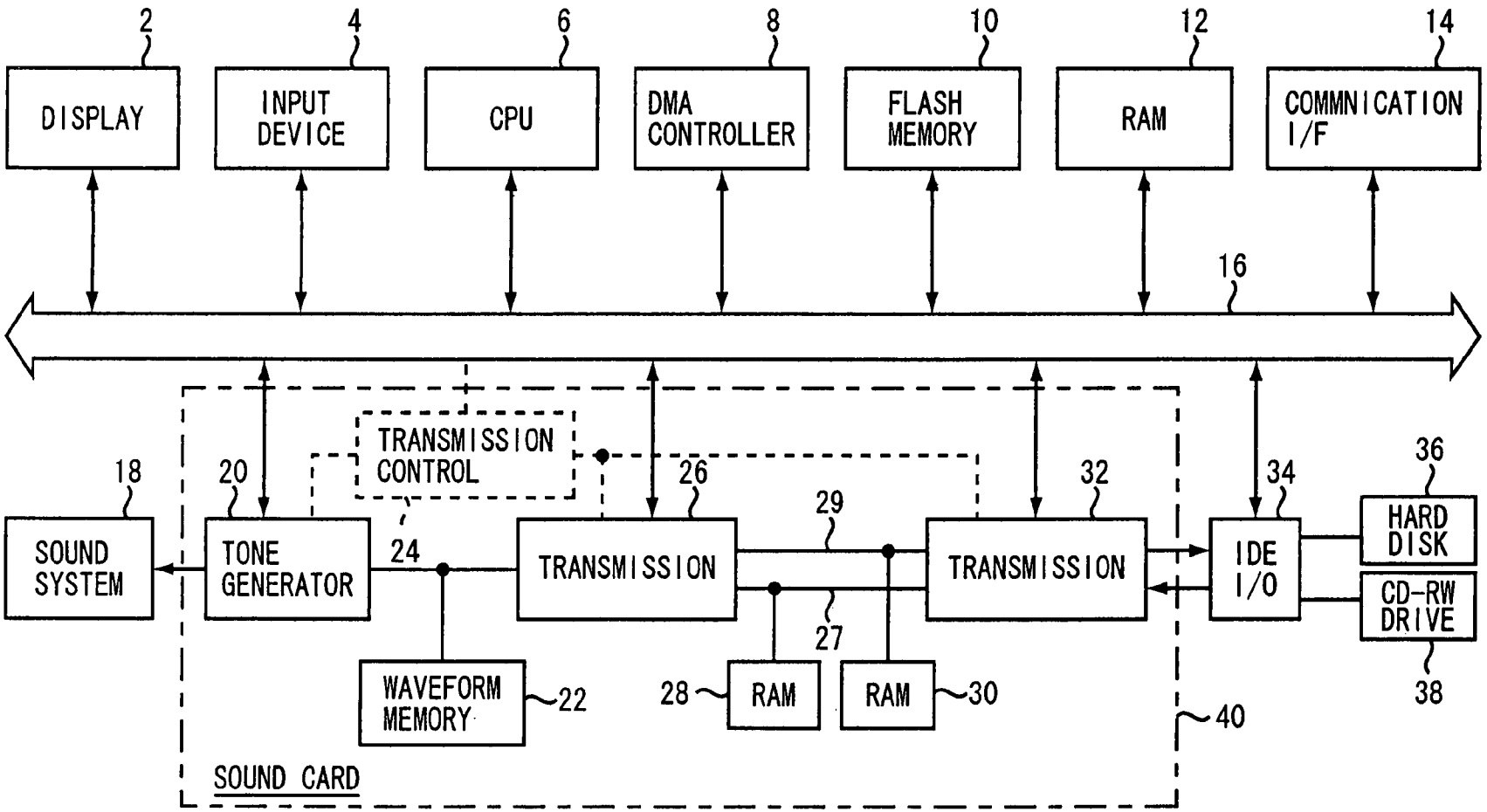
FIG. 1 is a block diagram of a musical sound signal generating system according to first and second embodiments of the present invention.

Next, a configuration of a musical sound signal generating system of a first embodiment according to the present invention will be explained with reference to FIG. 1.

The musical sound signal generating system according to the present embodiment is composed of a general-purpose personal computer, a sound board incorporated in the personal computer, and an application program operable on an operating system (OS) of the personal computer. In FIG. 1, reference numeral 2 represents a display for displaying various kinds of information for a user. Reference numeral 4 is an operator composed of a keyboard, a mouse, or the like. Reference numeral 6 represents a CPU for controlling other components via a bus 16 based on a program which will be described later. Reference numeral 10 represents a flash memory for storing an initial program loader or the like. Reference numeral 12 represents a RAM being used as a work memory of the CPU 10. Reference numeral 14 represents a communication interface for exchanging a MIDI signal or the like to other apparatuses.

Reference numeral 8 represents a DMA control circuit for executing various controls for outputting and inputting data from and to the RAM 12, without passing through the CPU 6. Reference numeral 36 represents a hard disk for storing the operating system of the personal computer, and the application program, the wave data, or the like of the musical sound signal generating system. In addition, reference numeral 38 represents a CD-RW drive for outputting and inputting data from and to a disk, such as CD-ROM, CD-R, and CD-RW. Reference numeral 34 represents an IDE I/O section for executing input/output processing to/from these hard disk 36 and CD-RW drive 38. Incidentally, various data are written on the hard disk 36 using a "cluster" (for example, 16 bit×32 k-word) as a unit, under the control of the IDE I/O section 34.

Reference numeral 40 represents a sound card in which the tone generator circuit 20 for synthesizing the musical sound signals of the maximum number of sound channels m (m is, for example 64) is provided. Reference numeral 22 represents a waveform memory (semiconductor memory) in which the partial data, each being approximately equivalent to several top clusters of respective wave data stored in the hard disk 36 are stored. Upon supplying a note-on signal from the CPU 6 to the sound card 40, the sound card 40 needs to start synthesizing the musical sound signals immediately, but if the hard disk 36 is accessed in order to obtain the wave data, a time lag will occur until the wave data are actually read. For that reason, by reading only top portions of respective wave data into the waveform memory 22 in advance, the time lag is eliminated.

Reference numerals 28 and 30 represent buffer memories (semiconductor memories) for transmitting the wave data from the hard disk 36 to the waveform memory 22, each having a capacity equivalent to "one cluster", and are respectively connected to the buses 27 and 29 which are mutually independent. Reference numerals 26 and 32 represent transmission processing sections, in which the transmission processing section 26 transmits the wave data equivalent to "one cluster", which are already read into the buffer memories 28 and 30, from the hard disk 36 to the waveform memory 22 during a period when the tone generator circuit 20 is not accessing the waveform memory 22. Meanwhile, the transmission processing section 32 reads the wave data equivalent to "one cluster" from the hard disk 36 according to an instruction from the CPU 6, and transmits the wave data to either buffer memory of the buffer memories 28 and 30, to which the transmission by the transmission processing section 26 has been completed.

The tone generator circuit 20 described above is provided with a plurality of sound channels, where it generates a read address for every sound channel to thereby read the wave data from the waveform memory 22, gives an envelope to the read wave data, and synthesizes the musical sound signals for every sound channel. Moreover, the tone generator circuit 20 mixes a plurality of synthesized musical sound signals, and adds effects, such as a reverb or the like, to the mixed musical sound signal thereto. Reference numeral 18 represents a sound system composed of an amplifier, a loudspeaker, or the like, for sounding the musical sound signal to which the effects are added. It should be noted that a transmission control section 24 shown with the broken line among respective components in FIG. 1 is not included in the present embodiment.

1.2. Operation of First Embodiment

1.2.1. Initialization Processing

Figure 2A:
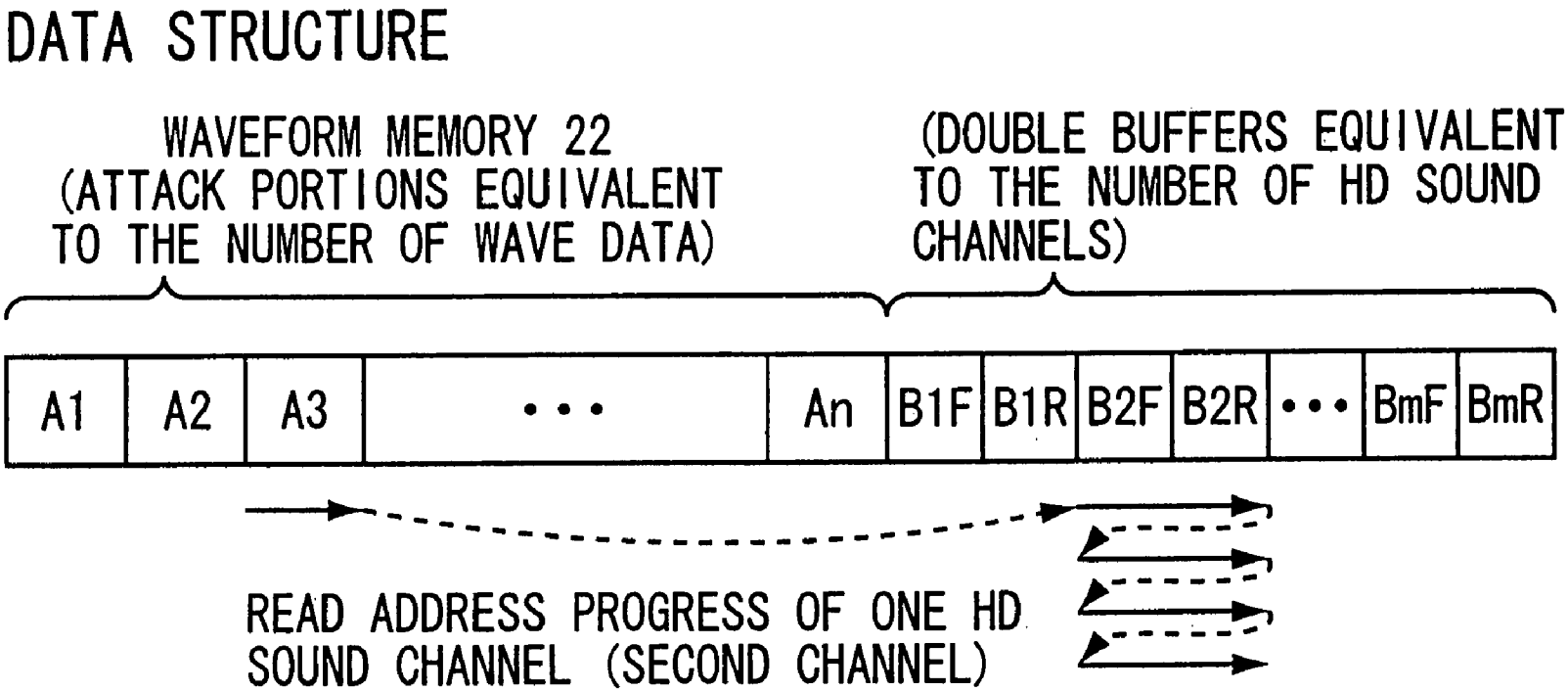
FIGS. 2(*a*) through 2(*c*) are an operation explanatory diagram according to the first embodiment.
Figure 2B:
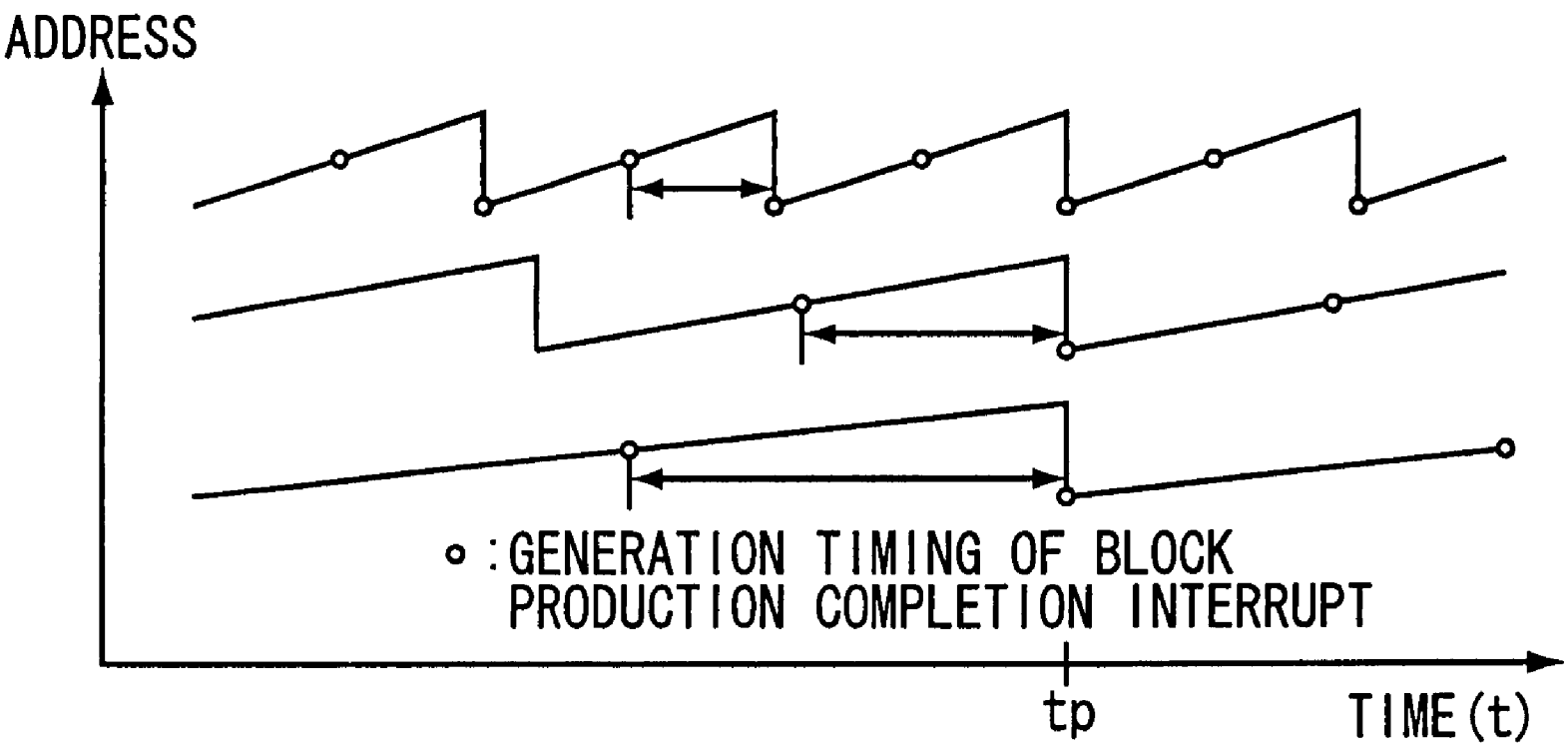
Figure 2C:
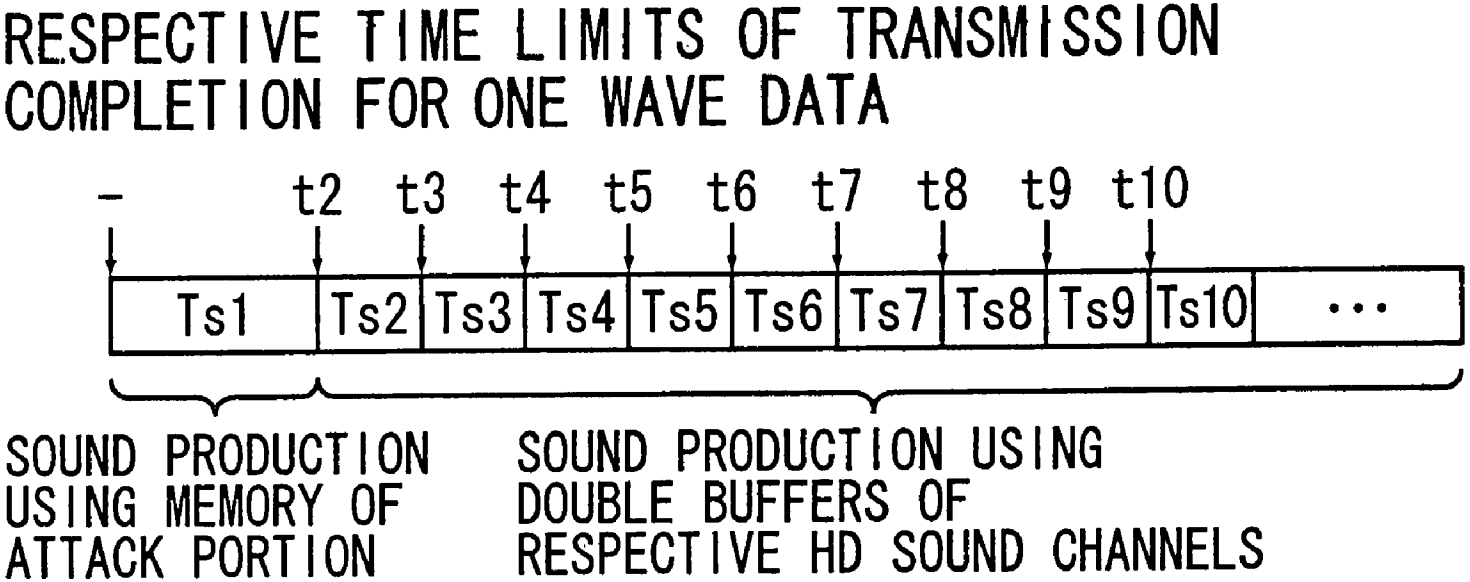

When the application program of the musical sound signal generating system is activated on the OS of the personal computer, the wave data stored in a predetermined directory in the hard disk 36 are searched, wave data corresponding regions A1 through An shown in FIG. 2(*a*) are secured in the waveform memory 22 according to the number of wave data n. Subsequently, the partial data of the top portions of these wave data are stored in the wave data corresponding regions A1 through An, respectively. The wave data corresponding regions A1 through An are preferably secured each by several clusters, but are not necessarily integral multiples of "one cluster", and the regions each having "one cluster" or more may be secured. A cluster length of the hard disk 36 is further detected, and respective pairs of channel corresponding regions B1F, B1R, B2F, B2R . . . , BmF, BmR, each being equivalent to "one cluster" length, are secured in the waveform memory 22 for respective sound channels of the maximum number of sound channels m. The channel corresponding regions BiF and BiR of an arbitrary sound channel i are continuously arranged in an address space of the waveform memory 22.

Figure 6:
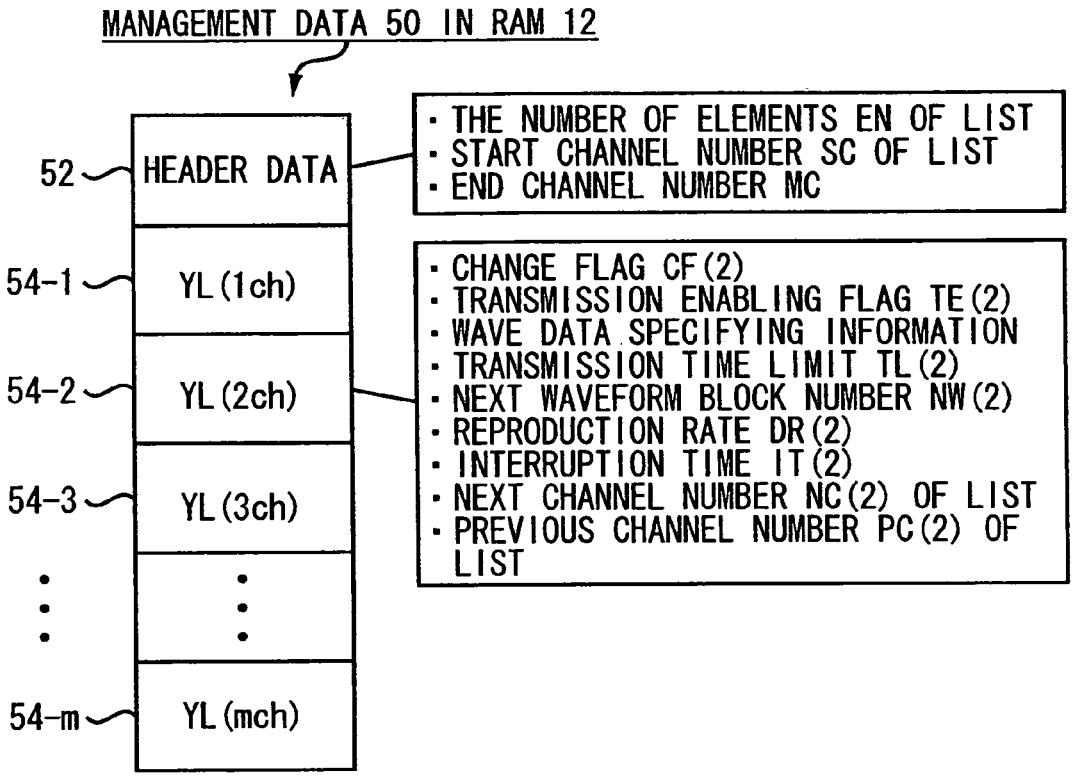
FIG. 6 is a data structure diagram according to the first embodiment.
Figure 7A:
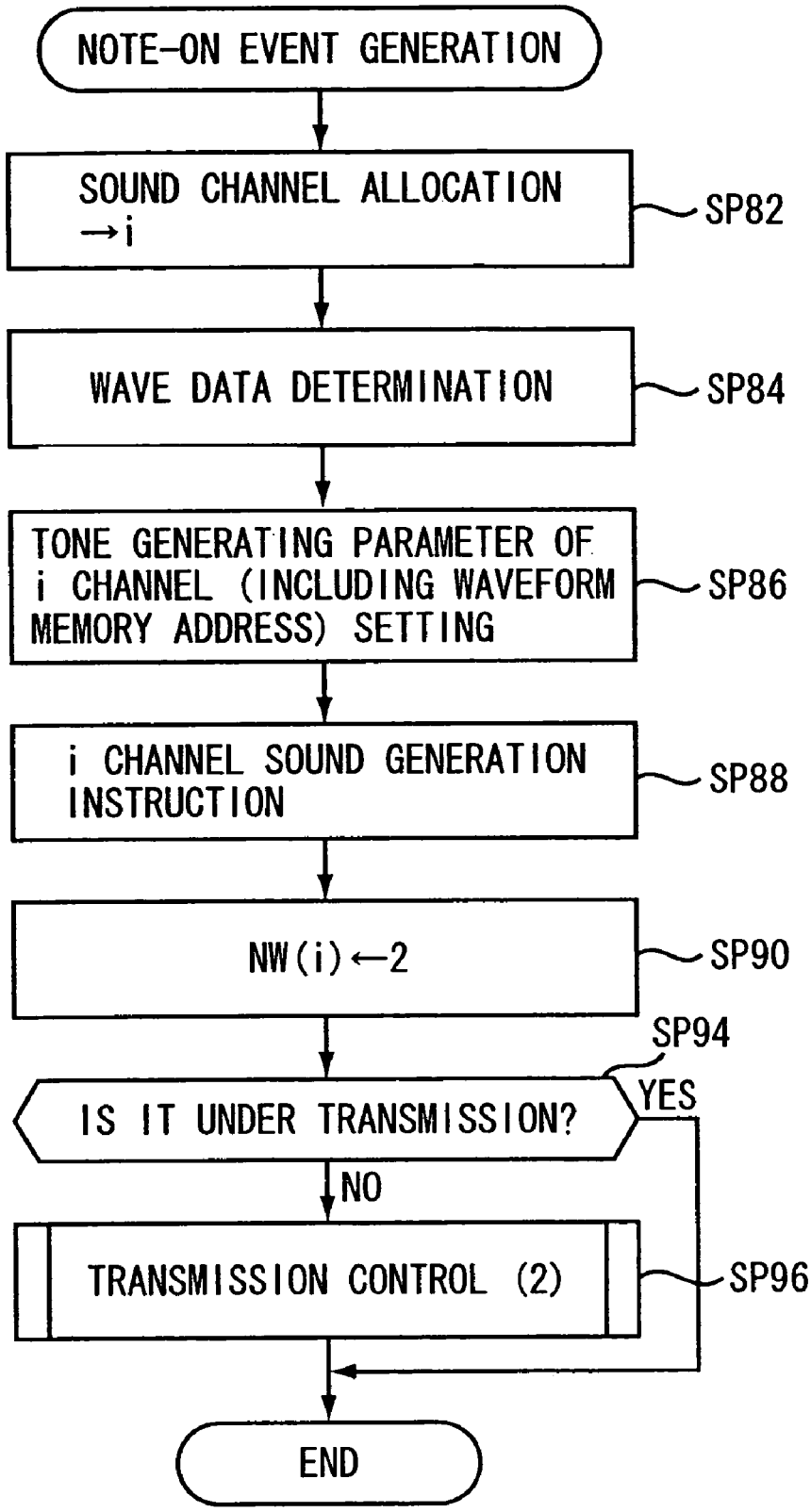
FIGS. 7(*a*) through 7(*d*) are a flow chart showing various processing routines according to a second embodiment.
Figure 7B:
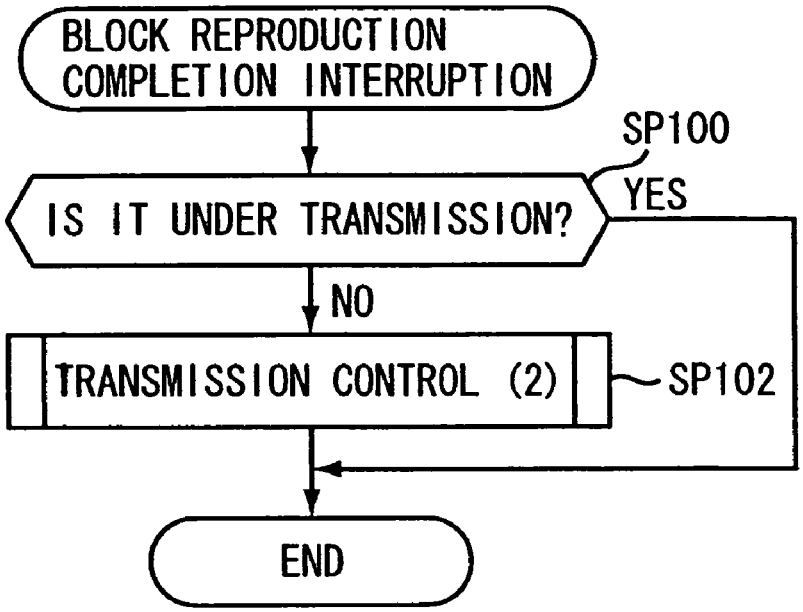
Figure 7C:
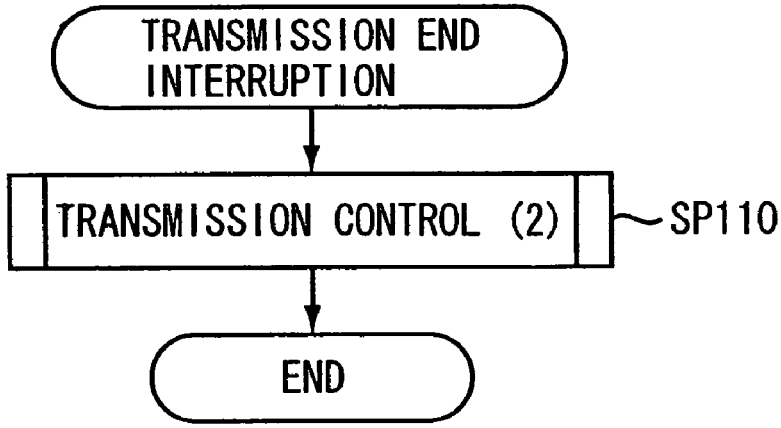
Figure 7D:
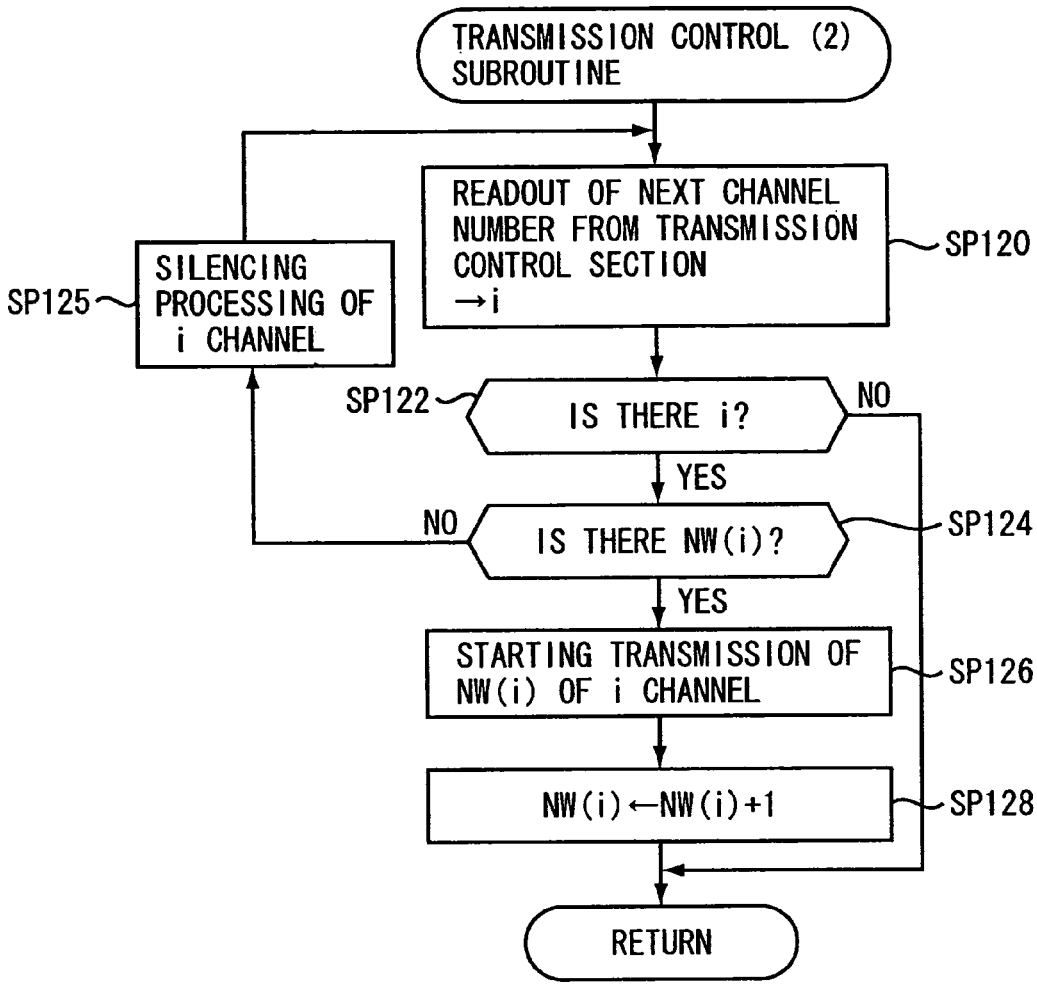
Figure 8A:
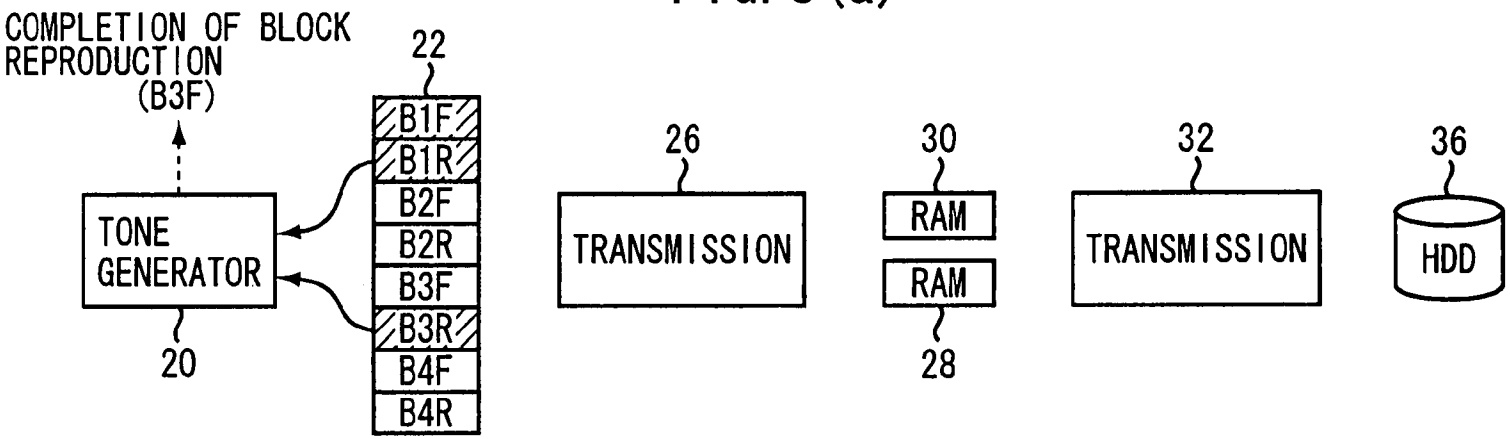
FIGS. 8(*a*) through 8(*d*) are an operation explanatory diagram according to the first and second embodiments.
Figure 8B:
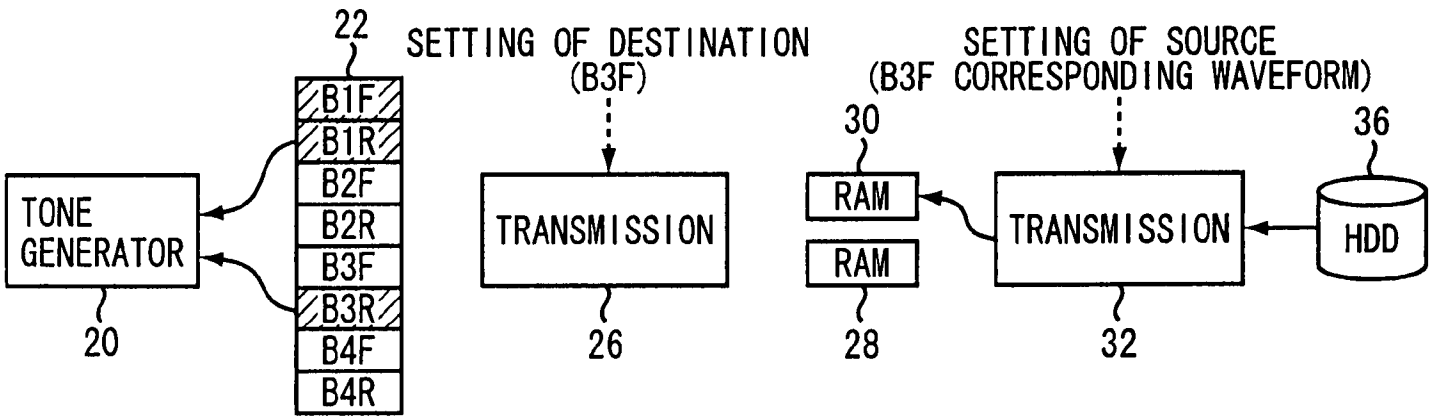
Figure 8C:
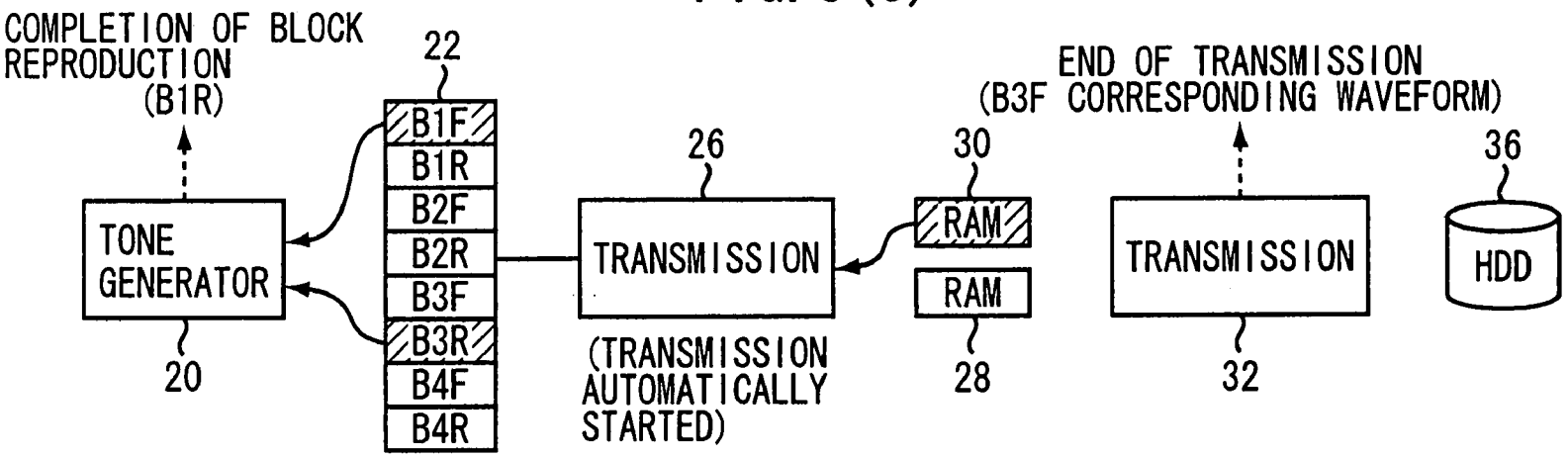
Figure 8D:
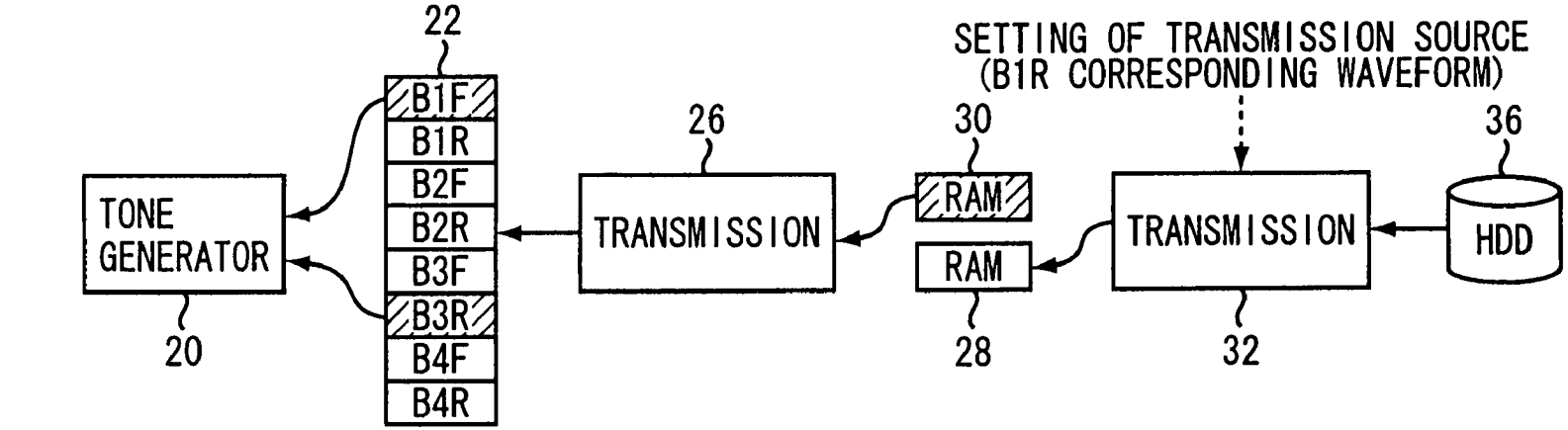

A region for management data 50 shown in FIG. 6 is then secured in the RAM 12 of the personal computer. In FIG. 6, the management data 50 is composed of header data 52 and channel data 54-1 through **54-*m* corresponding to the first through m-th sound channels, respectively. A list called "request list" is then formed in the management data 50 in a form of a bidirectionally-linked list. This request list arranges the channel data 54-1 through 54-*m* in the order for the partial data to be transmitted from the hard disk 36** to the channel corresponding regions.

In the management data 50, the number of elements EN of the request list (the number of transmission requests), a start channel number SC of the request list, and an end channel number MC of the request list are stored as a header data 52. Meanwhile, in the channel data **54-*i* according to each sound channel i, a next channel number NC(i) for indicating a next channel number in the request list, and a previous channel number PC(i) for indicating a previous channel number in the request list are stored. In other words, the request list is composed of EN elements in total obtained by sequentially linking an element of the sound channel indicated by the next channel number NC(i) with an element of the start channel number indicated by SC. Incidentally, in various kinds of processing described later, operations, such as adding a new element to the request list, deleting any element from the request list, changing a rank of the element, or the like will be executed. All of these operations will be executed by rewriting the aforementioned number of elements EN, start channel number SC, end channel number MC, and next channel number NC(i) and previous channel number PC(i) of each sound channel i, but the substantial addresses of respective channel data 54-1 through 54-*m*** would not necessarily be changed.

In addition, following information on the sound channel i is also stored in the channel data **54-*i***.

Change flag CF(i): this flag is set to "1" when an order of the channel data **54-*i*** in the request list needs to be revised, and set to "0" when there is no necessity of revising the order.

Transmission enabling flag TE(i): this flag is set to "1" when transmitting the partial data from the hard disk 36 to the channel corresponding region BiF or BiR is permitted, and is set to "0" when it is not permitted.

Transmission time limit TL(i): this data indicates a time to be a limit when the transmission of the partial data from the hard disk 36 to the channel corresponding region BiF or BiR should be completed. In FIG. 2(*c*), supposing that read periods of respective partial data by the tone generator circuit 20 are Ts1, Ts2, Ts3 . . . , times t2, t3 . . . just before Ts2, Ts3 . . . are started are the transmission time limits TL(i). It should be noted that since the top portion (attack portion) of the wave data is stored in the waveform memory 22 in advance, the corresponding transmission time limit TL(i) is not specified.

Next waveform block number NW(i): block numbers have been given to the partial data composing the respective wave data in ascending order. That is, a block number of the top portion to be read into the wave data corresponding region Ai is "1", block numbers of "2", "3", . . . are given to subsequent partial data for every equivalent of "one cluster". The next waveform block number NW(i) represents a block number of the partial data to be subsequently transmitted to the channel corresponding region BiF or BiR from the hard disk 36.

Reproduction rate DR(i): this data represents an address interval in the case of reading the waveform memory 22 and the buffer memories 28 and 30, and is determined corresponding to a pitch (f-number) of the sound channel i.

Interruption time IT(i): this data represents a time when a block reproduction completing interruption is finally generated to the sound channel i. It should be noted that the block reproduction completing interruption is generated at the timing when the playback of the partial data stored in a wave data corresponding region Ap and the channel corresponding region BiF or BiR is completed.

1.2.2. Generation of Note-On Event

Figure 3:
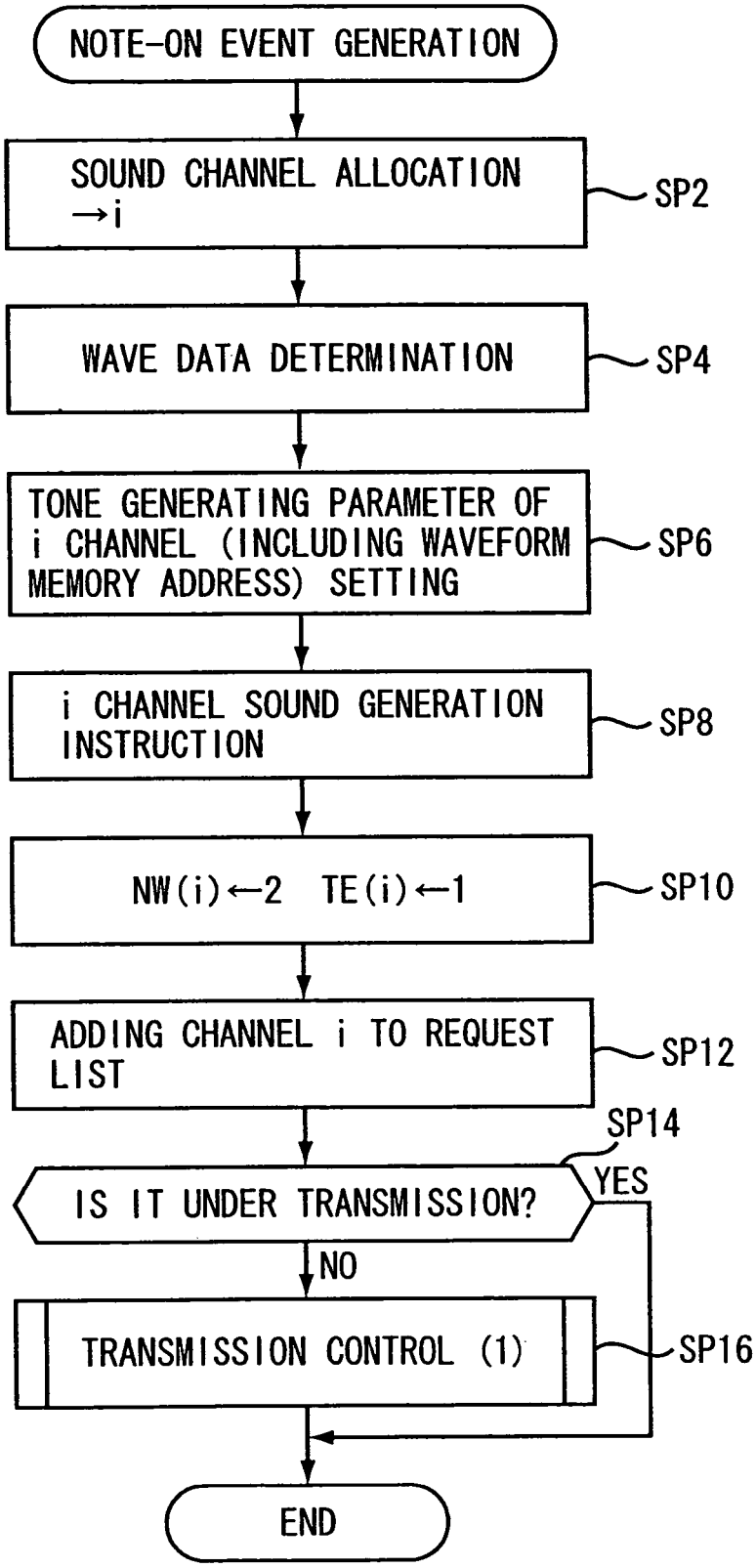
FIG. 3 is a flow chart showing a note-on event processing routine according to the first embodiment.

When a note-on event is generated in the MIDI signal supplied from a sequencer program within the personal computer, or the communication interface 14, a note-on event processing routine shown in FIG. 3 is activated in the CPU 6.

In FIG. 3, when the procedure proceeds to Step SP2, a free channel is searched for among the first to 64th sound channels in the tone generator circuit 20, and the found sound channel is allocated to the note-on event. A number of the sound channel allocated here is defined as "i". Next, when the procedure proceeds to Step SP4, one of the wave data is determined based on a tone color, a velocity, and a pitch corresponding to this note-on event. Next, when the procedure proceeds to Step SP6, the various parameters on the basis of the tone color, the velocity, and the pitch will be set for the sound channel i of the tone generator circuit 20. Here, the wave data corresponding region Ap ($1<p<n$) in the waveform memory 22 is uniquely determined based on the determined wave data, and the channel corresponding regions BiF and BiR are uniquely determined based on the channel number i.

Next, when the procedure proceeds to Step SP8, a sound instruction is transmitted to the sound card 40 so as to start the sound of the sound channel i. As a result, in the tone generator circuit 20, a readout of the wave data corresponding region Ap is started. Next, when the procedure proceeds to Step SP10, the next waveform block number NW(i) according to the sound channel i is set to "2", and the transmission enabling flag TE(i) is set to "1". In other words, as for the sound channel i, since it is in a state where only the wave data corresponding region Ap of the block number "1" is currently being read from the hard disk 36, the next waveform block number NW(i) is set to "2" which is the number of the block to be read next.

In addition, the channel corresponding region BiF as a region in which the partial data according to this next waveform block number NW(i) should be read is in a state ready for immediately reading the partial data, whereby the transmission enabling flag TE(i) is set to "1". Further, at Step SP10, the change flag CF(i) is set to "1", and the transmission time limit TL(i) is set to a scheduled time when the playback of the partial data in the wave data corresponding region Ai will be completed. Moreover, the reproduction rate DR(i) is set corresponding to the pitch (f-number) of the sound channel i, and the interruption time IT(i) is set to "0" ("0" indicates that the block reproduction completing interruption has not been generated yet).

Next, when the procedure proceeds to Step SP12, the channel data **54-*i* is added to the bottom of the request list. This is for requesting a transmission of the partial data of the block number "2" of the sound channel i. More specifically, supposing that the sound channel of the bottom of the request list is "j" in an actual situation, the next channel number NC(j) of the sound channel j is set to "i", and the previous channel number PC(i) of the sound channel i is set to "j". The next channel number NC(i) of the sound channel i is set to "0" for indicating the bottom of the list. Next, when the procedure proceeds to Step SP14, it is determined whether or not any partial data are being transmitted from the hard disk 36 to the buffer memory 28 or 30. If it is determined "YES" here, the procedure of this routine is immediately completed. Meanwhile, if it determined "NO" here, the procedure proceeds to Step SP16, where a transmission control subroutine which will be described (in FIG. 4**(*c*) later is called. Although the details will be described later, one transmission request is selected out of the request list, and transmission processing of the partial data is executed based on the transmission request.

1.2.3. Summary of Interruption Processing

Next, referring to FIGS. 8(*a*) through 8(*d*), a summary of various kinds of interrupt processing according to the present embodiment will be explained. In these Figures, it is supposed that the musical sound signals are synthesized from the wave data in the first and third sound channels. Accordingly, in the tone generator circuit 20, while the channel corresponding regions B1F and B1R are alternately read in the period according to a reproduction rate DR(1) of the first sound channel, the channel corresponding regions B3F and B3R will also be alternately read in the period according to a reproduction rate DR(3) of the third sound channel. It should be noted that a hatched region in the waveform memory 22 in these figures is a region in which the partial data is stored and not yet read by the tone generator circuit 20.

FIG. 8(*a*) shows a state of the third sound channel immediately after a readout of the channel corresponding region B3F is completed and a read address moves to the channel corresponding region B3R. When the readout of the channel corresponding region B3F is completed, the block reproduction completing interruption for acknowledging that the readout of the channel corresponding region B3F has been completed to the CPU 6 is generated by the tone generator circuit 20. As a result, the third sound channel is added to the bottom of the request list by the CPU 6. Here, supposing the request list is an empty list, the third sound channel will be a top sound channel of the request list.

Next, in FIG. 8(*b*), in response to this block reproduction completing interruption, the CPU 6 instructs the transmission processing section 32 to read the next partial data corresponding to the third sound channel. As a result, a readout of the partial data is started by the transmission processing section 32. The read partial data are sequentially transmitted to either of the buffer memories 28 and 30 (in the illustrated example, to the buffer memory 30). Here, from the CPU 6 to the transmission processing section 26, a channel corresponding region to which the partial data should be further transmitted (in this example, B3F) upon thoroughly completing the transmission of the partial data to the buffer memory 30 is specified at this moment.

Next, in FIG. 8(*c*), when the transmission of the partial data from the hard disk 36 to the buffer memory 30 is completed, while the completion is acknowledged from the transmission processing section 32 to the transmission processing section 26, a transmission end interruption is generated to the CPU 6. In the transmission processing section 26, in response to the aforementioned acknowledgement, the partial data transmission from the buffer memory 30 to the channel corresponding region (B3F) acknowledged previously is automatically started. In other words, in the transmission processing section 26, a timing when the tone generator circuit 20 is not reading the waveform memory 22 is detected, and the partial data are transmitted at the timing. Accordingly, in a state for the tone generator circuit 20 to access the waveform memory 22, this transmission processing is on standby. Meanwhile, in the CPU 6, in response to the transmission end interruption, whether or not partial data of other channels can be transmitted is determined, and when the partial data can be transmitted, the procedure for the transmission of the partial data is executed. Among the above procedures, since the data transfer executed in the transmission processing section 26 is uniquely executed by the transmission processing section 26, without involving the CPU 6, there is no procedure to be urgently required in the CPU 6 in particular. This is because the CPU 6 previously specifies the channel corresponding region to which the partial data should be transmitted for the transmission processing section 26 in a previous stage in FIG. 8(*b*). As described above, according to the present embodiment, the channel corresponding region to which the partial data should be transmitted is previously specified for the transmission processing section 26, whereby frequency of the occurrence of procedures urgently required for the CPU 6 can be reduced.

Incidentally, in FIG. 8(*c*), it is assumed that a readout of the channel corresponding region B1R has been completed in the first sound channel. For that reason, the block reproduction completing interruption for acknowledging that the readout of the channel corresponding region B1R has been completed to the CPU 6 is generated by the tone generator circuit 20. Consequently, the first sound channel is added to the bottom of the request list by the CPU 6. Here, supposing the request list is an empty list, the first sound channel will be the top sound channel of the request list.

Next, in FIG. 8(*d*), in response to this block reproduction completing interruption, the CPU 6 instructs the transmission processing section 32 to read the next partial data corresponding to the third sound channel. As a result, a readout of the partial data is started by the transmission processing section 32. The read partial data are sequentially transmitted to either of the buffer memories 28 and 30, to which the last transmission processing has not been provided (in the illustrated example, to the buffer memory 28). As described above, since the partial data transmission from the buffer memories 28 and 30 to the waveform memory 22 is executed at the timing when the tone generator circuit 20 is not reading the waveform memory 22, the partial data that has not been transmitted yet to the waveform memory 22 may still remain in the buffer memory 30 at this moment as illustrated in the example. According to the present embodiment, however, since the buffer memories 28 and 30 are alternately used, the transmission processing by the transmission processing section 32 can be continued, with leaving the wave data in the buffer memory 30.

As described above, the transmission processing from the buffer memories 28 and 30 to the channel corresponding regions BiF and BiR executed by the transmission processing section 26 is not executed until the occurrence of the timing when the tone generator circuit 20 is not reading the waveform memory 22. However, such timing will occur frequently. Besides, since such transmission processing is a transmission between semiconductor memories, the procedure is completed shortly after the procedure is actually started. Meanwhile, the transmission processing from the hard disk 36 to the buffer memories 28 and 30 by the transmission processing section 32 is accompanied with a mechanical operation such as a head movement, a disk rotation or the like, resulting in very slow processing as compared with the transmission processing by the transmission processing section 26. In other words, when the transmission processing section 32 starts the transmission processing to either one of the buffer memories 28 and 30, the other buffer memory will surely be in empty state by the time when the transmission processing is completed. Accordingly, as will be understood, there may not probably occurs such a situation that, for example, although the hard disk 36 is in a data transmittable state, the data transmission is kept standing by because of an incomplete preparation on the side of the transmission processing sections 26 and 32. After all, according to the present embodiment, the maximum transmission speed of the partial data from the hard disk 36 to the waveform memory 22 is mostly determined by the performance of the hard disk 36, thereby making it possible to sufficiently make the best performance of the hard disk 36. As will be understood, such a feature, from the CPU 6 point of view, may result in that, "Shortly after the transmission end interruption is generated (when the transmission to either one of the buffer memories is completed), the transmission to the other buffer memory may be started". As a result, in the CPU 6, it is not necessary to confirm whether or not the other buffer memory is empty, and the procedure is not kept waiting due to a reason that "The other buffer memory is not empty", either. That makes it possible to further reduce a burden against the CPU 6.

1.2.4. Operation of Sound Card 40 Referring now to FIGS. 2(*a*) and 2(*b*), an operation in the sound card 40 will be explained. As described above, generating of the note-on event according to the sound channel i initiates the readout of the partial data in the wave data corresponding region Ap according to the sound channel. Readout procedure is executed for every predetermined sampling period, and the reproduction rate DR(i) is added to the read address for every sampling period. Here, since the reproduction rate DR(i) can be defined as the number of decimal places, a calculated value of the read address which is an accumulation result of the reproduction rate DR(i) will normally have the number of decimal places. In such a case, sampling values of the addresses preceding or following the calculation result are read, and an interpolation operation is performed based on a fractional value. As a result, even when the calculated value of the read address has a fractional value, sampling values with a reduced return noise can be calculated.

Here, upon completing the readout of the wave data corresponding region Ap, the partial data in the channel corresponding regions BiF and BiR corresponding to the sound channel i are alternately read thereafter. Subsequently, in the tone generator circuit 20, while the envelope is given to the read partial data, a sound effect process is also executed as required, so that the resultant musical sound signal is sounded via the sound system 18. In addition, in the tone generator circuit 20, when any readout among the wave data corresponding region Ap, and the channel corresponding regions BiF and BiR is completed, the block reproduction completing interruption to the CPU 6 occurs. Meanwhile, when the partial data transmission from the hard disk 36 to the buffer memories 28 and 30 is completed with respect to any one of the sound channels, the transmission end interruption occurs.

1.2.5. Procedure of Transmission Control Subroutine (FIG. 4(*c*))

Figure 4A:
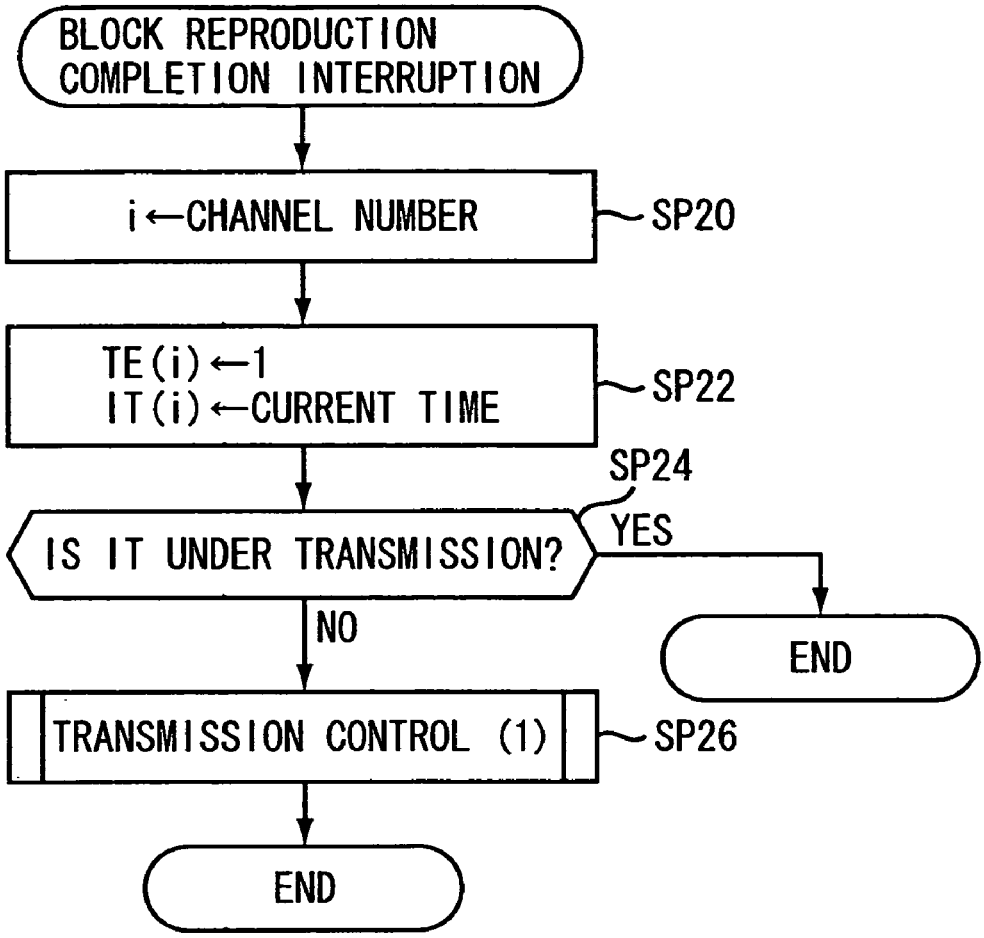
FIGS. 4(*a*) through 4(*c*) are a flow chart showing various processing routines according to the first embodiment.
Figure 4B:
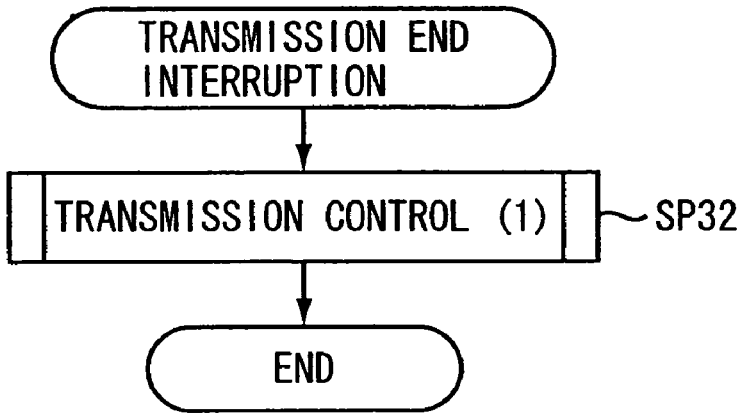
Figure 4C:
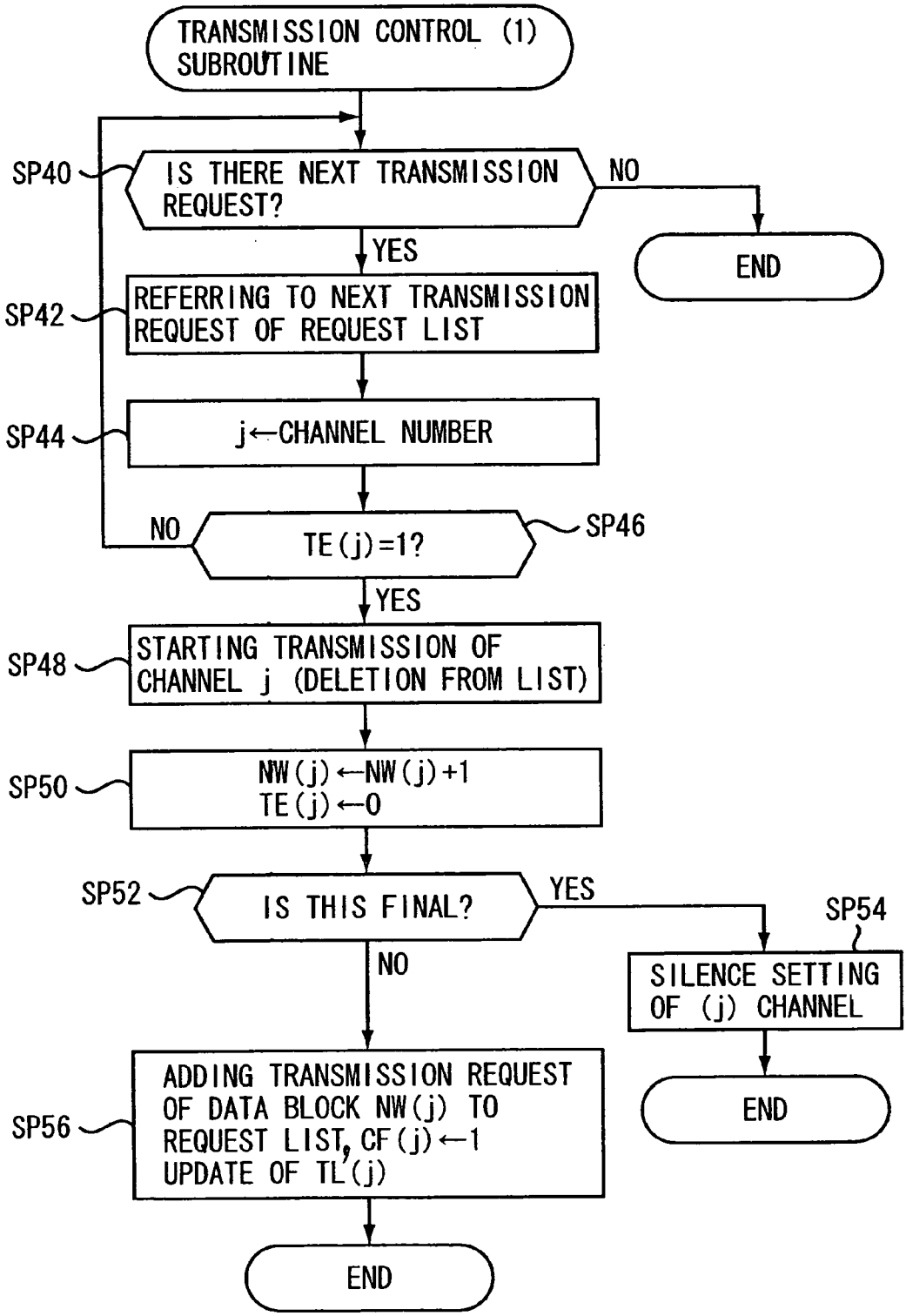

When the transmission control subroutine shown in FIG. 4(*c*) is called, the procedure will proceed to Step SP40, and it is determined whether or not the next transmission request (element) is present in the request list. If it is determined "NO" here, the routine procedure is immediately terminated. Meanwhile, if it is determined "YES" at Step SP40, the procedure proceeds to Step SP42, and the next transmission request of the request list is referenced. In other words, when this routine is called to execute Step SP40 first, it is determined whether or not the top element of the request list is present, and when Step SP40 is executed thereafter, it is sequentially determined whether or not the next element is present. Next, when the procedure proceeds to Step SP44, the sound channel number according to the transmission request determined to be "present" is substituted for a variable j.

Next, when the procedure proceeds to Step SP46, it will be determined whether or not the transmission enabling flag TE(j) according to the sound channel j is "1". If it is determined "NO" here, the procedure will return to Step SP40, and the procedure of the aforementioned Steps SP40 through SP44 is executed to the next transmission request of the sound channel j in the request list. This is because even when a certain sound channel is positioned in the top of the request list, unless the transmission enabling flag according to the sound channel is "1", the transmission of the channel cannot be started, and therefore the transmission of the sound channel having the next high priority level is executed.

As described above, when the sound channel j with the highest priority level within the request list, among the sound channels which can transmit, is detected, the procedure will proceed to Step SP48. Here, the CPU 6 instructs the transmission processing section 32 to perform the transmission processing accompanied by the sound channel j and the next waveform block number NW(j). As a result, in the wave data which are stored in the hard disk 36 and are allocated to the sound channel j under the control of the transmission processing section 32, the partial data by one cluster specified by the next waveform block number NW(j) are read, and the transmission to the buffer memory 28 or 30 is started. Moreover, at the Step SP48, the CPU 6 specifies the channel corresponding region (BjF or BjR) to which the transmitted partial data should be further transmitted for the transmission processing section 26. In the CPU 6, the transmission request according to the sound channel j is then deleted from the request list.

Next, when the procedure proceeds to Step SP50, the next waveform block number NW(j) according to the sound channel j is incremented by "1", and the transmission enabling flag TE(j) is set to "0". Here, the reason why the transmission enabling flag TE(j) is set to "0" will be explained. As described above, in the tone generator circuit 20, when the readout of the wave data corresponding region Ap is completed, the channel corresponding regions BjF and BjR in the sound channel j are alternately read. When the aforementioned Step SP48 is executed in the situation, the partial data are transmitted to the buffer memory 28 or 30, and after an appropriate time, the partial data are transmitted to "a region not under readout at present" of the channel corresponding regions BjF and BjR.

When the next waveform block number NW(j) is incremented by "1" at Step SP50, a destination region according to the next waveform block number NW(j) will be "a region under readout at present" of the channel corresponding regions BjF and BjR. Accordingly, such a transmission processing cannot be executed immediately, and it is necessary to put a restriction so that the transmission processing will not be executed until the completion of the readout of "the region under readout at present". For this reason, at Step SP50, the transmission enabling flag TE(j) is set to "0".

Next, when the procedure proceeds to Step SP52, it is determined whether or not the partial data (block number=NW(j)−1), the transmission of which has previously started at Step SP48, are the final partial data of the wave data. If it is determined "YES" here, the procedure proceeds to Step SP54, where an instruction is issued to the tone generator circuit 20 to perform silencing processing of the sound channel j. In other words, when the tone generator circuit 20 receives the instruction, the musical sound signal of the sound channel j is gradually faded out, and the sound channel j is released after an appropriate time. Meanwhile, if it is determined "NO" at Step SP50, the procedure will proceed to Step SP56. Here, the transmission request of next waveform block number NW(j) is added to the bottom of the request list. As described above, since the contents of the request list are read from the top, the transmission request is processed in the order of arrival even in the worst case. Moreover, when the background processing routine which will be described later (FIG. 5) is executed, since the request list is sorted in order of the transmission time limit TL(j), the request list will be in a more desirable situation, but it will be understood that even if the background processing routine is not executed, the request list is composed so as not to be hard to cause a failure.

Further, at Step SP56, while the change flag CF(j) is set to "1", the transmission time limit TL(j) is updated. First, although the transmission request of the next waveform block number NW(j) is added to the bottom of the request list, the priority of this transmission request is not necessarily the lowest priority among the transmission requests included in the request list. Accordingly, in order to review the priority level in background processing which will be described later, it is necessary to set the change flag CF(j) to "1". Meanwhile, the transmission time limit TL(j) is set to a scheduled time when the playback of all of the partial data that have already been transmitted to the channel corresponding regions BjF and BjR (or that have started to be transmitted at Step SP48) will complete. According to the procedure described above, the procedure of this subroutine is completed.

1.2.6. Event Processing of Block Reproduction Completion (FIG. 4(*a*))

When the block reproduction completing interruption occurs in any sound channel i, event processing of block reproduction completion shown in FIG. 4(*a*) is executed. In FIG. 4(*a*), when the procedure proceeds to Step SP20, a channel number in which the interruption has occurred is substituted for a variable i. Next, when the procedure proceeds to Step SP22, the transmission enabling flag TE(i) is set to "1". This is because a destination region of the next waveform block number NW(i) is either of the channel corresponding regions BiF and BiR, in which the playback has been completed at this moment, and since the playback of the region has been completed, new partial data can be transmitted at any time. In addition, at Step SP22, a current time is substituted for the interruption time IT(i).

In addition, when the interruption time IT(i) is updated, the transmission time limit TL(i) is recalculated and updated based on the interruption time IT(i) and the reproduction rate DR(i) of this sound channel i. Since a value of the transmission time limit TL(i) before the update should be the same as that of the interruption time IT(i) unless the pitch of the sound channel i changes, calculating a new transmission time limit TL(i) based on the transmission time limit TL(i) before the update may also be considered. In practice, when the pitch is changed a little by operation of a pitchbend or th like, however, the transmission time limit TL(i) before the update is out of coincidence with the interruption time IT(i). For this reason, it is desirable to recalculate the transmission time limit TL(i) based on the newest interruption time IT(i) and reproduction rate DR(i). Next, when the procedure proceeds to Step SP24, it is determined whether or not certain partial data are being transmitted from the hard disk 36 to the buffer memory 28 or 30. If it is determined "YES" here, the procedure of this routine is immediately completed. Meanwhile, if it determined "NO" here, the procedure proceeds to Step SP26, and the aforementioned "transmission control subroutine (FIG. 4(*c*))" is called.

1.2.7. Transmission End Event Processing (FIG. 4(*b*))

In the sound card 40, upon completing the transmission to any region in the buffer memories 28 and 30, the transmission end interruption occurs and a transmission end event processing routine shown in FIG. 4(*b*) is activated. In the routine, only the transmission control subroutine (FIG. 4(*c*)) is called. In other words, as long as the partial data transmission is available, whenever the transmission is completed, the transmission control subroutine is called repeatedly, so that the transmission processing is continuously executed.

Figure 5:
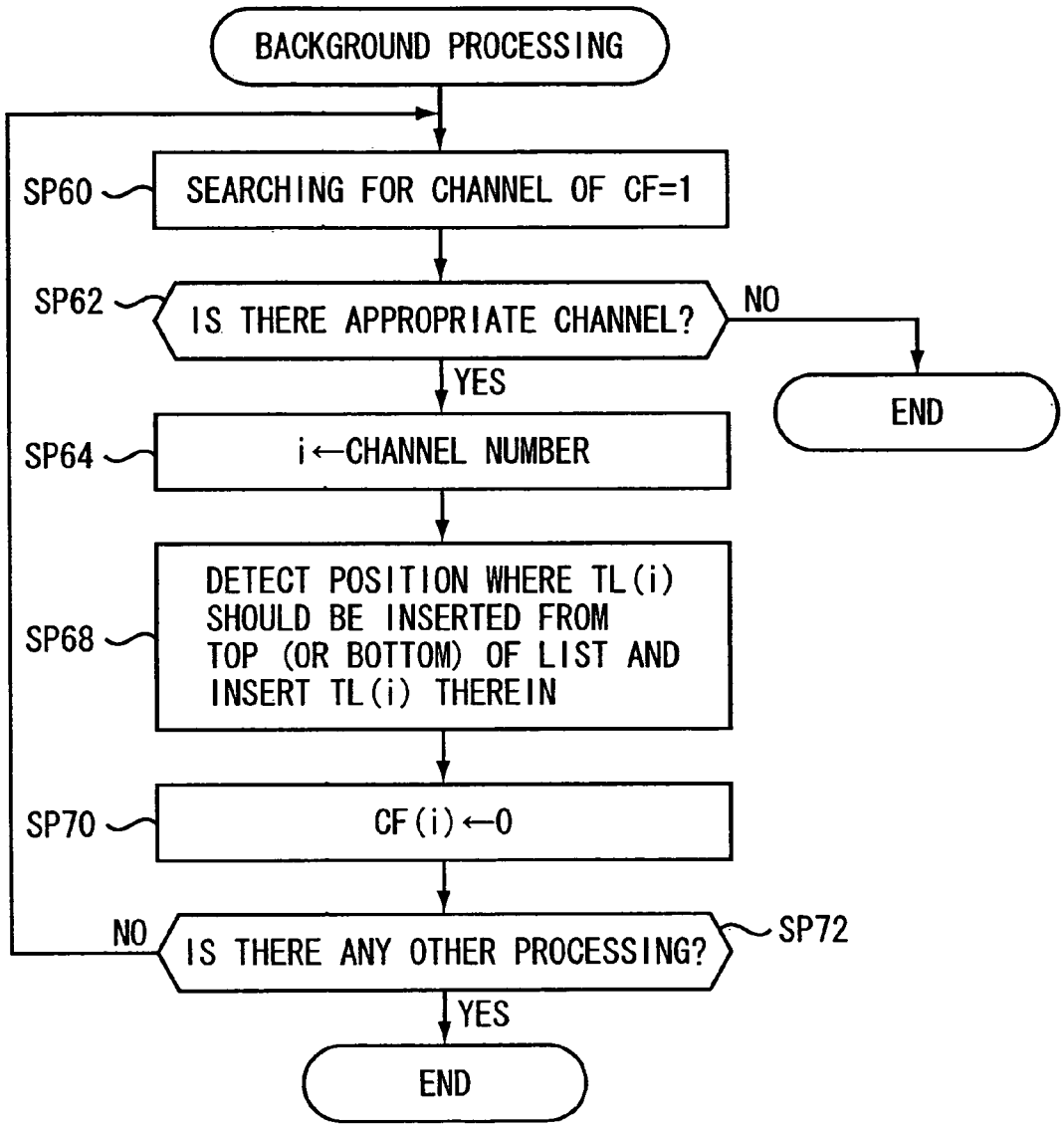
FIG. 5 is a flow chart showing a background processing routine according to the first embodiment.

1.2.8. Background Processing (FIG. 5)

The CPU 6 can process a plurality of tasks at the same time, and an activity ratio of the CPU 6 is always monitored. If the activity ratio becomes lower than a predetermined value, the background processing routine shown in FIG. 5 is then activated. In FIG. 5, when the procedure proceeds to Step SP60, a channel whose change flag CF(i) is "1" is searched for among the sound channels belonging to the request list. Next, when the procedure proceeds to Step SP62, it is determined whether or not such a channel is found. If it is determined "NO" here, the routine procedure is immediately terminated.

Meanwhile, if it is determined "YES" at Step SP62, the procedure proceeds to Step SP64, the found channel number is substituted for the variable i. Next, when the procedure proceeds to Step SP68, a position to which the transmission request of the transmission time limit TL(i) is to be moved is detected from the top of the request list. In other words, the transmission time limit TL(j) of the sound channel j other than the sound channel i is sequentially searched from the top of the request list, and if the transmission time limit TL(j) later than the transmission time limit TL(i) is found, the transmission request of the sound channel i is moved to a position immediately preceding the sound channel j in the request list.

Next, when the procedure proceeds to Step SP70, the change flag CF(i) is set to "0". Next, when the procedure proceeds to Step SP72, it is determined whether or not some processing other than the background processing is executed. If it is determined "NO" here, the procedure of Steps SP60 through SP70 is repeated. Meanwhile, if it is determined "YES" at Step SP72, in order to give priority to other procedure, the routine is immediately terminated.

As described above, according to the routine, since the transmission requests of the respective sound channels are sorted in ascending order of the transmission time limit TL, in the aforementioned transmission control subroutine (FIG. 4(*c*)), it is determined whether or not the transmission requests can be transmitted in ascending order of the transmission time limit TL (whether or not the transmission enabling flag TE is "1"). As will be understood, in the routine, since a sound channel with the earliest transmission time limit TL is selected among the sound channels whose transmission enabling flag TEs are "1", a situation where the partial data is not transmitted in time can be prevented in advance.

2. Second Embodiment

2.1. Hardware Configuration of Second Embodiment

Next, a second embodiment of the present invention will be explained. Although a hardware configuration of the second embodiment is the same as that of the first embodiment, a transmission control section 24 shown with a broken line is added to the sound card 40. This transmission control section 24 controls the sequence of the sound channels to which the partial data are transmitted from the hard disk 36.

2.2. Operation of Second Embodiment 2.2.1. Initialization Processing

When the application program of the musical sound signal generating system is activated in the personal computer, in a manner similar to that of the aforementioned first embodiment, the wave data stored in a predetermined directory in the hard disk 36 are searched, the wave data corresponding regions A1 through An are secured in the waveform memory 22, and the partial data of the top portions of these wave data are stored in the wave data corresponding regions A1 through An, respectively. Moreover, the channel corresponding regions B1F, B2F . . . , BmF and B1R, B2R . . . , BmR, each having "one cluster" equivalent length, are secured in the buffer memories 28 and 30 for respective sound channels, respectively.

Next, a region for management data is then secured in the RAM 12 of the personal computer, but the management data in the embodiment is different from that of the first embodiment, so that data relevant to the "request list" are not included. In other words, the data corresponding to the header data 52 are not included in the management data, and the start channel number SC and the end channel number MC are not included in the respective channel data 54-1 through **54-*m*. It is because the information corresponding thereto is controlled by the transmission control section 24** in the present embodiment.

2.2.2. Generation of Note-on Event

When a note-on event is generated in the MIDI signal or the like supplied from the communication interface 14, a note-on event processing routine shown in FIG. 7(*a*) is activated in the CPU 6.

In the Steps SP82 through SP88 of that routine, a procedure similar to that of Steps SP2 through SP8 of the first embodiment is executed. That is, the sound channel i is allocated to the note-on event, and while the wave data are determined, various parameters are set to the sound channel i of the tone generator circuit 20, and a sound instruction is transmitted to the sound card 40.

Next, when the procedure proceeds to Step SP90, the next waveform block number NW(i) in the channel data **54-*i* in the RAM 12 is set to "2". Next, when the procedure proceeds to Step SP94, it is determined whether or not certain partial data are being transmitted from the hard disk 36 to the buffer memory 28 or 30. If it is determined "YES" here, the procedure of this routine is immediately terminated. Meanwhile, if it determined "NO" here, the procedure proceeds to Step SP96, and a transmission control subroutine, which will be described (in FIG. 7**(*d*)) later is called.

2.2.3. Operation of Sound Card 40

In the sound card 40, operation of portions other than the transmission control section 24 is similar to that of the first embodiment. In the embodiment, following procedures are further executed in the transmission control section 24.

First, in the transmission control section 24, there is generated a "channel number list" which is a list for listing sound channels that satisfy all of following conditions among all the sound channels during sounding.

(1) The partial data can be transmitted to either of the channel corresponding regions BiF and BiR according to the sound channel i.

(2) A silencing instruction to the sound channel i is not received from the CPU 6.

In addition, a value (for example, "0") which is a channel number not being actually present is added to the bottom of the list. In the transmission control section 24, the transmission time limit TL(i) allowing the playback of the wave data is calculated for all of the sound channels i belonging to this channel number list based on the partial data already written in the waveform memory 22, and the "channel number list" which is a list obtained by sorting the channel numbers in ascending order of this transmission time limit TL(i) is generated. However, since the transmission control section 24 itself does not concern whether or not the next waveform block number NW(i) is present, a sound channel in which the next waveform block is not actually present may also be included in the channel number list.

In addition, the channel number list generated in the transmission control section 24 can be freely read using the CPU 6. In the transmission control section 24, the channel corresponding regions BjF and BjR of the respective sound channels j are successively monitored, and according to the propriety of partial data transmission, the sound channel j is added to the channel number list, or the sound channel j is deleted from the channel number list. Additionally, at the same time, this list is successively sorted according to the transmission time limit TL(i) as described above. Accordingly, for example, if the CPU 6 reads the top of the channel number list, it causes reading of a sound channel i having a free channel corresponding region BiF or BiR and the highest order after the sort.

2.2.4. Transmission Control Subroutine

When the transmission control subroutine shown in FIG. 7(*d*) is called, the procedure will proceed to Step SP120, where the channel number which is the top element of the channel number list in the transmission control section 24 is read by the CPU 6, and the result is substituted for the variable i. As described above, unless the channel number to be subjected to the transmission processing is present, a predetermined value (for example, "0") is read. Next, when the procedure proceeds to Step SP122, it is determined whether or not the channel number to be subjected to the transmission processing is present (whether or not it is a value other than "0").

If it is determined "NO" here, the routine procedure is immediately terminated. Meanwhile, if it is determined "YES" here, the procedure proceeds to Step SP124, it is determined whether or not the partial data corresponding to the next waveform block number NW(i) are present. For example, in the case when the transmission of a whole block of the corresponding wave data is completed, it is determined "NO" here and the procedure proceeds to Step SP125, where the silencing instruction of the sound channel i is provided from the CPU 6 to the tone generator circuit 20. As a result, the musical sound signal of the sound channel i is gradually faded out, and the sound channel i is released after an appropriate time. Moreover, when this silencing instruction is detected by the transmission control section 24, an element according to the sound channel i is deleted from the channel number list. When the procedure then returns to Step SP120, the next channel number is read from the transmission control section 24, and the determinations of Steps SP122 and SP124 are repeated.

If it is determined "YES" at Step SP124, the procedure proceeds to Step SP126. Here, the CPU 6 instructs the transmission processing section 32 to perform the transmission processing accompanied by the sound channel j and the next waveform block number NW(j). As a result, in the wave data, which are stored in the hard disk 36 and allocated to the sound channel j under the control of the transmission processing section 32, the partial data by one cluster specified by the next waveform block number NW(j) are read, and the transmission to the buffer memory 28 or 30 is started. Further, in the Step SP126, the CPU 6 specifies the channel corresponding region (BjF or BjR) to which the transmitted partial data should be further transmitted for the transmission processing section 26. Next, when the procedure proceeds to Step SP128, the next waveform block number NW(i) is incremented by "1", and the procedure of the routine is then completed.

2.2.5. Event Processing of Block Reproduction Completion (FIG. 7(*b*))

When the block reproduction completing interruption is generated in any sound channel, an event processing routine of block reproduction completion shown in FIG. 7(*b*) is executed. In FIG. 7(*b*), when the procedure proceeds to Step SP100, it is determined whether or not certain partial data are being transmitted from the hard disk 36 to the buffer memory 28 or 30. If it is determined "YES" here, the procedure of this routine is immediately terminated. Meanwhile, if it determined "NO" here, the procedure proceeds to Step SP102, where the aforementioned transmission control subroutine (FIG. 7(*d*)) is called.

2.2.6. Transmission end Event Processing (FIG. 7(*c*))

In the sound card 40, upon completing the transmission to any region in the buffer memories 28 and 30, the transmission end interruption occurs and a transmission end event processing routine shown in FIG. 7(*c*) is activated. In the routine, simply the transmission control subroutine (FIG. 7(*d*)) is called. In other words, as long as the partial data transmission is available, the transmission processing is continuously executed in the transmission control subroutine.

As described above, according to the present embodiment, except for management of the next waveform block number NW or the like, most of the management of the channel number list corresponding to the request list of the first embodiment is left to the transmission control section 24 which is hardware. Thereby, the present embodiment can reduce a processing load on the CPU 6 as compared with the first embodiment.

3. Modified Embodiment

The present invention is not limited to the embodiments described above, but various modifications may be made to the present invention, for example as follows.

(1) In the aforementioned respective embodiments, various procedures have been executed with the application program which operates on the personal computer, but this application program may be distributed by storing only the same in the recording media, such as CD-ROM, flexible disk, or the like, or also distributed through a transmission path.

(2) In the aforementioned respective embodiments, the buffer memories 28 and 30 and the waveform memory 22 have been incorporated in the sound card 40, but the incorporation of these memories may be omitted by securing areas for these memories in the RAM 12.

(3) In the aforementioned respective embodiments, the "reproduction rate DR(i)" has been determined corresponding to the pitch (f-number) of the sound channel i, but the "reproduction rate" of the present invention does not need to be uniquely determined corresponding to the pitch (f-number). For example, it would be considered that the wave data stored in the hard disk 36 might be wave data obtained by compressing data, and in that case, a rate for the partial data in the buffer memories 28 and 30 to be consumed with respect to the same f-number is lower than that of the uncompressing wave data. Moreover, since resolutions of the wave data may be different for every wave data, such as "8 bits", "16 bits", "24 bits", or the like, the higher the resolution of the wave data becomes, the faster the rate for the partial data in the buffer memories 28 and 30 to be consumed becomes.

(4) Moreover, in the aforementioned respective embodiments, the request list has been created based on the transmission time limit TL of one block partial data to be transmitted next, but the request list may be created so that the transmission time limits TLs of a plurality of n blocks to be transmitted thereafter may be calculated and the calculated transmission time limits TLs may be all included.

(5) In addition, in the aforementioned embodiments, all the sound channels during sounding have been included in the request list, but only a sound channel i in which either of the channel corresponding regions BiF and BiR is writable may be included in the request list.

(6) In addition, as another configuration method of the request list, the request list may be composed of only the sound channels having subsequent unread partial data in the hard disk 36.

(7) In addition, as for the wave data whose whole size is small, the whole wave data is stored in the waveform memory 22 as an attack portion, so that the wave data may be played back without transmitting the wave data from the hard disk 36.

In such a case, before executing Step SP10 of FIG. 3 and Step SP90 of FIG. 7(*a*), it is determined whether or not it is the wave data, the whole of which is stored in the waveform memory 22 as the attack portion, and if this determination result is negative, Steps SP10 and SP90 of the aforementioned embodiment are executed, meanwhile if the determination result is affirmative, following Steps SP10' and Step SP90' may be executed instead of them.

Step SP10': the next waveform block number NW(i) is set to a state of "nothing" (for example, "0"), and the transmission enabling flag TE(i) is set as "0".

Step SP90': the next waveform block number NW(i) is set to a state of "nothing" (for example, "0").

(8) In the aforementioned embodiments, the channel corresponding regions B1F, B1R, B2F, B2R . . . , BmF, BmR have been secured to all the sound channels corresponding to the maximum number of sound channels m. However, "the wave data, the whole of which is stored in the waveform memory 22 as the attack portion" as the aforementioned modified embodiment does not require such channel corresponding regions. Accordingly, a part of the sound channels of the tone generator circuit 20 are intended for exclusive sound channels for the wave data, so that the number of channel corresponding regions may be reduced by the number corresponding to the number of exclusive sound channels.

(9) In the aforementioned embodiments, at the time of activation of the application program, the partial data of the top portions of the respective wave data have been read to the wave data corresponding regions A1 through An, but the timing of reading the wave data is not limited to this. For example, these wave data may be read upon activating the OS. Moreover, if a part of the waveform memory 22 is composed of a nonvolatile memory, such as a flash memory, a battery backup type RAM, or the like, once the partial data of the top portion are read, it will become unnecessary to read the partial data again whenever the OS and the application program are activated. Further, if a part of the waveform memory 22 is composed of a ROM and the partial data of the top portion are stored therein, the read itself may be made unnecessary.

(10) In addition, in the aforementioned embodiments, although the background processing routine (FIG. 5) is executed on condition that the activity ratio of the CPU 6 becomes lower than a predetermined value, the timing of executing the routine is not limited to this, but in short, the background processing routine may be executed by making the priority lower as compared with other procedures. For example, when the CPU 6 can deal with multi-tasks, the routine may be kept in an always executable state within the background processing process and then the priority of the process may be set up low as compared with other processes.

In addition, by monitoring a duration of an idle period while the CPU 6 does not substantially perform processing, the background processing routine may be activated when this idle period becomes a predetermined time period or more. However, in the background processing routine, if the management data 50 are updated by other processing in the middle of the execution of Steps SP64 through SP70, the background processing routine malfunctions, and therefore preferably the management data 50 should be locked against other processes during the period of executing Steps SP64 through SP70.

(11) In addition, at the Step SP68 of the aforementioned embodiments, it is also possible t o detect the position where the transmission request of the transmission time limit TL(i) should be inserted from the bottom of the request list. In this case, however, a sound channel whose change flag CF(j) is "1" needs to be ignored. In other words, the transmission time limits TLs(j) of sound channels j other than the sound channel i are sequentially searched from the bottom of the request list, and, if there is found "a sound channel j which has a transmission time limit TL(j) earlier than the transmission time limit TL(i) and whose change flag CF(j) is "0"", the transmission request of the sound channel i may be inserted in the position immediately following the sound channel j.

(12) In addition, while the data amount of "one block" which is a unit for the hard disk 36 to store the wave data has been the same as "one cluster" in the aforementioned embodiments, they need not be always coincident with each other. In other words, "one block" may be composed of "a plurality of clusters".

(13) In addition, in the aforementioned embodiments, the example of applying the hard disk 36 as the first recording medium has been explained, but MO, CD, DVD, or the like may be applied as the first recording medium.

(14) In addition, in the aforementioned embodiments, the two channel corresponding regions BiF and BiR have been provided in the waveform memory 22 for every sound channel i, but "3" or more channel corresponding regions may be provided for every sound channel i.

(15) In addition, the channel corresponding regions of respective sound channels do not need to be separated into the equivalents of "one cluster" each. In other words, the channel corresponding region may be composed of one region having a size equal to or more than "two clusters" (not limited to the integral multiples of "one cluster") for one sound channel. In such a case, a write pointer for indicating to which address the write is completed, and a read pointer for indicating to which address the readout is completed may be secured in the RAM 12 for every sound channel, and when a difference between both pointers becomes one cluster or more, the block reproduction completing interruption may be generated.

(16) In addition, in this example, when a total of the channel corresponding regions of one sound channel exceeds the equivalent of "two clusters", the block reproduction completing interruption may be generated at every timing when the difference between both pointers exceeds two clusters. For example, if the channel corresponding region is the equivalent of "three clusters", the block reproduction completing interruption is generated whenever the difference between both pointers becomes two clusters, the partial data transmission from the hard disk 36 to the waveform memory 22 via the buffer memories 28 and 30 is performed twice, the partial data of the equivalent of "two clusters" may be supplied in one-time block reproduction completing interruption.

What is claimed is:

1. An access controller apparatus for use in a musical sound signal generating system including a first recording medium for storing wave data, a second recording medium for storing the wave data and having an access speed faster than that of the first recording medium, a transmitting section for reading the wave data sequentially in units of a data block composing a part of the wave data from the first recording medium to thereby transmit the wave data to the second recording medium, and a musical sound signal generating section having a plurality of sound channels each of which reads the wave data from the second recording medium at a speed corresponding to a reproduction rate of each sound channel to reproduce a musical sound signal according to the read wave data, the access controller apparatus comprising:

a detecting section that detects one or more sound channels that have enough vacant area for storing respective next data blocks in the second recording medium, and further detects a sound channel which will complete the reproducing of the data block stored in the second recording medium at the earliest timing among the detected one or more sound channels based on the reproduction rates of the respective sound channels; and a sound channel specifying section that controls the transmitting section to transmit the next data block of the sound channel detected by the detecting section from the first recording medium to the second recording medium.

2. The access controller apparatus according to claim 1, wherein the musical sound signal generating system has a rate storage section for storing the reproduction rate of each sound channel, the first recording medium is a recording medium for storing the wave data in units of the data block having a predetermined size, and the second recording medium has a plurality of storage regions for each sound channel such that each of the data locks is alternately written to the plurality of the storage regions of each sound channel.

3. The access controller apparatus according to claim 1, wherein the detecting section produces a list of the sound channels in an ascending order of the timings at which the respective sound channels complete reproducing of the data block stored in the second recording medium, for detecting the sound channel ranked at the top order in the list.

4. A musical sound signal generating method performed in a musical sound signal generating system having a first recording medium for storing wave data, a second recording medium for storing the wave data and having an access speed faster than that of the first recording medium, a transmitting section for reading the wave data sequentially in units of a data block composing a part of the wave data from the first recording medium to thereby transmit the wave data to the second recording medium, and a musical sound signal generation section having a plurality of sound channels each of which reads the wave data from the second recording medium at a speed corresponding to a reproduction rate of each sound channel to reproduce a musical sound signal according to the read wave data, the musical sound signal generating method comprising:

a detecting step of detecting one or more sound channels that have enough vacant area for storing respective next data blocks in the second recording medium, and further detecting a sound channel which will complete the reproducing of the data block stored in the second recording medium at the earliest timing among the detected one or more sound channels based on the reproduction rates of the respective sound channels; and a sound channel specifying step of controlling the transmitting section to transmit the next block data of the detected sound channel from the first recording medium to the second recording medium.

5. The musical sound signal generating method according to claim 4, wherein the musical sound signal generating system has a rate storage section for storing the reproduction rate of each sound channel, the first recording medium is a recording medium for storing the wave data in units of the data block having a predetermined size, the second recording medium has a plurality of storage regions for each sound channel such that each data block is alternately written to the plurality of the storage regions of each sound channel, and the detecting step includes producing a list of the sound channels in an ascending order of the timings at which the respective sound channels complete the reproducing of the data blocks stored in the second recording medium, for detecting the sound channel ranked at a top order in the list.

6. A musical sound signal generating apparatus comprising:

a wave data storage that stores a plurality of wave data in the form of data blocks which have a predetermined size and which are obtained by dividing each of the wave data;

a rate storage that stores a plurality of reproduction rates corresponding to a plurality of channels;

a plurality of buffers, corresponding to the plurality of the channels, each of which temporarily stores wave data of the corresponding channel;

a sound generator that reads out the wave data of each of the channels from the buffers at a speed corresponding to the reproduction rate of the channel in said rate storage and generates sound signals of the channels based on the wave data read out from the respective buffers;

a specifying section that specifies a next data block of each of the channels to be transferred from the data storage to the buffer of the channel;

a calculating section that calculates, for each of the channels, a remaining time representing how long said sound generator can keep reading out the wave data in the buffer of the channel, based on the reproduction rate of the channel in said rate storage;

a producing section that produces a list of the channels in an ascending order of the remaining times calculated for the respective channels;

a detector that detects one or more channels of which the buffer has a vacant area that stores the wave data already read out by said sound generator and that exceeds a predetermined size as the sound generator reads out the wave data from the buffers;

a selecting section that sequentially reads out a channel detected by said detector from the list in the ascending order and selects the channel; and a transferring section that reads out the next data block of the selected channel, specified by the specifying section, from the wave data storage and transfers the read next data block to the buffer of the selected channel.

7. A musical sound signal generating apparatus comprising:

a wave data storage that stores a plurality of wave data in the form of data blocks which have a predetermined size and which are obtained by dividing each of the wave data;

a rate storage that stores a plurality of reproduction rates corresponding to a plurality of channels;

a plurality of buffers, corresponding to the plurality of the channels, each of which temporarily stores wave data of the corresponding channel;

a sound generator that reads out the wave data of each of the channels from the buffers at a speed corresponding to the reproduction rate of the channel in said rate storage and generates sound signals of the channels based on the wave data read out from the respective buffers;

a transferring section that transfers the wave data a block by block basis from the wave data storage to the buffers; and a control section that executes a data processing program comprising:

a step of specifying a next data block of each of the channels to be transferred from the wave data storage to the buffer of the channel;

a step of calculating, for each of the channels, a remaining time representing how long said sound generator can keep reading out the wave data in the buffer of the channel, based on the reproduction rate of the channel in said rate storage;

a step of producing a list of the channels in an ascending order of the remaining times calculated for the respective channels;

a step of detecting one or more channels of which the buffer has a vacant area that stores the wave data already read out by said sound generator and that exceeds a predetermined size as the sound generator reads out the wave data from the buffers;

a step of reading out a channel detected by said detector from the list in the ascending order and selecting the channel; and a step of instructing said transferring section to transfer the next data block of the selected channel, specified by the specifying step, from the wave data storage to the buffer of the selected channel.

8. A musical sound signal generating apparatus comprising:

a wave data storage that stores a plurality of wave data in the form of data blocks which have a predetermined size and which are obtained by dividing each of the wave data;

a rate storage that stores a plurality of reproduction rates corresponding to a plurality of channels;

a plurality of buffers, corresponding to the plurality of the channels, each of which temporarily stores wave data of the corresponding channel;

a sound generator that reads out the wave data of each of the channels from the buffers at a speed corresponding to the reproduction rate of the channel in said rate storage and generates sound signals of the channels based on the wave data read out from the respective buffers;

a transferring section that transfers the wave data on a block by block basis from the wave data storage to the buffers;

a calculating section that calculates, for each of the channels, a remaining time representing how long said sound generator can keep reading out the wave data in the buffer of the channel, based on the reproduction rate of the channel in said rate storage;

a producing section that produces a list of the channels in an ascending order of the remaining times calculated for the respective channels;

a detector that detects one or more channels of which the buffer has a vacant area that stores the wave data already read out by said sound generator and that exceeds a predetermined size as the sound generator reads out the wave data from the buffers;

a control section; and a notifying section that sequentially reads out a channel detected by said detector from the list in the ascending order and selects the channel, and that notifies the control section of the selected channel;

wherein the control section executes a data processing program comprising:

a step of specifying a next data block of each of the channels to be transferred from the wave data storage to the buffer of the channel; and a step of instructing said transferring section to transfer the next data block of the selected channel, specified by the specifying step, from the wave data storage to the buffer of the selected channel.

* * * * *